US010294591B2

(12) United States Patent
Podhajny et al.

(10) Patent No.: US 10,294,591 B2
(45) Date of Patent: May 21, 2019

(54) METHOD FOR FORMING A SEAMLESS KNITTED ABUTMENT

(71) Applicant: NIKE, INC., Beaverton, OR (US)

(72) Inventors: Daniel A. Podhajny, Beaverton, OR (US); Tory M. Cross, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 479 days.

(21) Appl. No.: 15/008,544

(22) Filed: Jan. 28, 2016

(65) Prior Publication Data

US 2016/0219966 A1 Aug. 4, 2016

Related U.S. Application Data

(60) Provisional application No. 62/109,741, filed on Jan. 30, 2015.

(51) Int. Cl.

| | |
|---|---|
| ***D04B 1/10*** | (2006.01) |
| ***A43B 1/04*** | (2006.01) |
| ***D04B 1/22*** | (2006.01) |

(52) U.S. Cl.

CPC ..... *D04B 1/108* (2013.01); *A43B 1/04* (2013.01); *D04B 1/22* (2013.01); *D10B 2501/043* (2013.01)

(58) Field of Classification Search

CPC . D04B 1/108; D04B 1/22; D04B 1/10; D04B 1/123; D04B 1/26

See application file for complete search history.

(56) References Cited

U.S. PATENT DOCUMENTS

| | | | |
|---|---|---|---|
| 2,069,021 | A | 1/1937 | Schuessler |
| 4,967,494 | A | 11/1990 | Johnson |
| 6,227,010 | B1 | 5/2001 | Roell |
| 6,986,269 | B2 | 1/2006 | Dua |
| 8,448,474 | B1 | 5/2013 | Tatler et al. |
| 2006/0010931 | A1 | 1/2006 | Lynch et al. |
| 2012/0233884 | A1 | 9/2012 | Greene |
| 2013/0160323 | A1 | 6/2013 | Hsiao |
| 2013/0269209 | A1 | 10/2013 | Lang et al. |
| 2013/0269212 | A1 | 10/2013 | Little |
| 2014/0137433 | A1 | 5/2014 | Craig |
| 2014/0150292 | A1 | 6/2014 | Podhajny et al. |

(Continued)

FOREIGN PATENT DOCUMENTS

| | | |
|---|---|---|
| EP | 2 157 219 | 2/2010 |
| EP | 2157219 A1 | 2/2010 |
| TW | 201350038 A | 12/2013 |

(Continued)

OTHER PUBLICATIONS

International Preliminary Report on Patentability for International Application No. PCT/US2013/070651, dated Jun. 4, 2015.

(Continued)

*Primary Examiner* — Danny Worrell

(74) *Attorney, Agent, or Firm* — Brinks Gilson & Lione

(57) ABSTRACT

A method for forming a seamless knitted abutment may include a joining thread. The joining thread may extend between a first portion and a second portion in a first orientation. The joining thread may be tensioned and bring the first portion and the second portion together. The first portion and the second portion may be then oriented in a second orientation.

15 Claims, 24 Drawing Sheets

(56) References Cited

U.S. PATENT DOCUMENTS

| | | | |
|---|---|---|---|
| 2015/0075031 | A1 | 3/2015 | Podhajny et al. |
| 2016/0198797 | A1 | 7/2016 | Ikenaka |

FOREIGN PATENT DOCUMENTS

| | | | |
|---|---|---|---|
| TW | 201402030 | A | 1/2014 |
| TW | 201425679 | A | 7/2014 |
| TW | M498500 | U | 4/2015 |
| WO | WO 98/35081 | A1 | 8/1998 |
| WO | WO 2013/126313 | A2 | 8/2013 |

OTHER PUBLICATIONS

International Search Report and Written Opinion for International Application No. PCT/US2013/070651, dated Mar. 27, 2014 (14 pages).
International Search Report and Written Opinion for International Application No. PCT/US2015/015340, dated Apr. 28, 2015 (10 pages).
International Search Report and Written Opinion for International Application No. PCT/US2015/015343, dated Jun. 16, 2015 (11 pages).
International Search Report and Written Opinion for International Application No. PCT/US2015/015346, dated Apr. 22, 2015 (10 pages).
International Search Report and Written Opinion for International Application No. PCT/US2016/026345, dated Oct. 4, 2016 (20 pages).
Office Action for Chinese Application No. 2013800364497, dated Sep. 25, 2015 (6 pages).
Office Action for European Application No. 13814673.3, dated Jun. 30, 2015 (2 pages).
Office Action for Korean Application No. 10-2014-7036252, dated Jan. 21, 2016 (11 pages).
Office Action for Taiwanese Application No. 102142337, dated May 27, 2015 (36 pages).
Office Action for Taiwanese Application No. 102142337, dated Sep. 21, 2015 (33 pages).
Office Action for Taiwanese Application No. 105111914, dated Dec. 26, 2016 (19 pages).
International Search Report and Written Opinion for International Application No. PCT/US2016/015325, dated Aug. 4, 2016 (20 pages).
Office Action, and English language translation thereof, in corresponding Taiwan Application No. 105103053, dated Jul. 7, 2017, 8 pages.
International Preliminary Report on Patentability in corresponding International Application No. PCT/US2016/015325, dated Aug. 1, 2017, 11 pages.

METHOD FOR FORMING A SEAMLESS KNITTED ABUTMENT

BACKGROUND

Conventional articles of footwear generally include two primary elements, an upper and a sole structure. The upper and the sole structure, at least in part, define a foot-receiving chamber that may be accessed by a user's foot through a foot-receiving opening.

The upper is secured to the sole structure and forms a void on the interior of the footwear for receiving a foot in a comfortable and secure manner. The upper member may secure the foot with respect to the sole member. The upper may extend around the ankle, over the instep and toe areas of the foot. The upper may also extend along the medial and lateral sides of the foot as well as the heel of the foot. The upper may be configured to protect the foot and provide ventilation, thereby cooling the foot. Further, the upper may include additional material to provide extra support in certain areas.

The sole structure is secured to a lower area of the upper, thereby positioned between the upper and the ground. The sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

A variety of material elements (e.g. textiles, polymer foam, polymer sheets, leather, synthetic leather) are conventionally utilized in manufacturing the upper. In athletic footwear, for example, the upper may have multiple layers that each includes a variety of joined material elements. As examples, the material elements may be selected to impart stretch-resistance, wear resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas.

As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and number of material elements. Further, multiple pieces that are stitched together may cause a greater concentration of forces in certain areas. The stitch junctions may transfer stress at an uneven rate relative to other parts of the article of footwear which may cause failure or discomfort. Additional material and stitch joints may lead to discomfort when worn. By decreasing the number of material elements utilized in the upper, therefore, waste may be decreased while increasing the manufacturing efficiency, the comfort, performance, and the recyclability of the upper.

SUMMARY

In one aspect, a method of forming a knitted component, the method includes the steps of knitting a first portion of the knitted component with a first thread along a first course direction. Additionally the method includes knitting a second portion of the knitted component with a second thread, the first thread being distinct from the second thread. The second portion of the knitted component having a first engaging subset including a plurality of loops and a second engaging subset including a plurality of loops, the plurality of loops being held by a plurality of needles. The first portion of the knitted component has a first engaging side which includes a plurality of loops. The method further includes interlooping at least one of the plurality of loops of the first engaging subset with at least one of the plurality of loops of the first engaging side. The method further includes knitting a third portion of the knitted component with the first thread along the first course direction, the third portion of the knitted component including a second engaging side including a plurality of loops. The method further includes, interlooping at least one of the plurality of loops of the second engaging subset with at least one of the plurality of loops of the second engaging side.

In another aspect, a method of assembling an article of footwear incorporating a knitted component into an upper, the method includes forming the knitted component in a planar configuration including a first edge and a second edge. The knitted component is formed of courses which are secured. The method further includes knitting a joining thread between the first edge and the second edge in a planar configuration. The joining thread including a first end and a second end, at least one of the first end and the second end being unsecured. The joining thread interlooping with at least one loop on the first edge and the joining thread interlooping with at least one loop on the second edge. The method further includes tensioning at least one of the first end and the second end of the joining thread such that the first edge and the second edge extend toward one another; and incorporating the knitted component into the upper of the article of footwear.

In another aspect, a method of assembling an article of footwear incorporating a knitted component into an upper, the method including forming the knitted component in a planar configuration including a base portion, a first lateral portion, and a second lateral portion. The knitted component being formed of courses which are secured. The method further including, knitting a joining thread between the first lateral portion and the second lateral portion, the joining thread including a first end and a second end. At least one of the first end and the second end being unsecured. The joining thread interlooping with at least one loop on a first edge of the first lateral portion and the joining thread interlooping with at least one loop on a second edge of the second lateral portion. The method further including tensioning at least one of the first end and the second end of the joining thread such that the first edge and the second edge extend toward one another; and incorporating the knitted component into the upper of the article of footwear.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the Figures are not necessarily to scale, emphasis instead being placed upon illustrating the principles of the embodiments. Moreover, in the Figures, like reference numerals designate corresponding parts throughout the different views.

The foregoing Summary and the following Detailed Description will be better understood when read in conjunction with the accompanying Figures.

DETAILED DESCRIPTION

Figure 1:
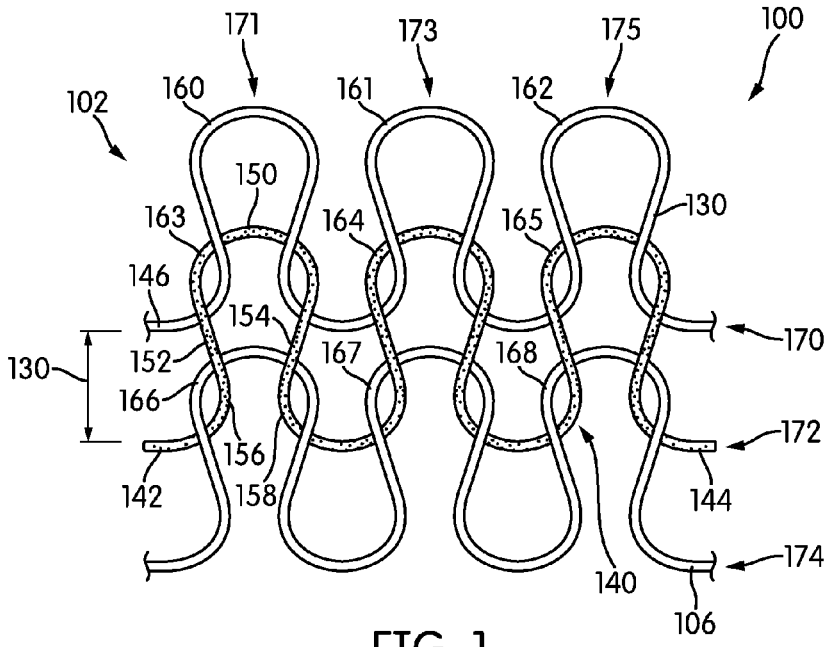
FIG. 1 is a representational view of an exemplary embodiment of a knit structure incorporating a joining thread.

The following discussion and accompanying Figures disclose a variety of concepts relating to knitted components and the manufacture of knitted components. Although the knitted components may be utilized in a variety of products, an article of footwear that incorporates one of the knitted components is disclosed below as an example. In addition to footwear, the knitted components may be utilized in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted components may also be utilized in bed coverings (e.g., sheets, blankets), table coverings, towels, flags, tents, sails, and parachutes. The knitted components may be utilized as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, the knitted components and other concepts disclosed herein may be incorporated into a variety of products for both personal and industrial purposes.

For clarity, the detailed descriptions herein describe certain exemplary embodiments, but the disclosure herein may be applied to any article of footwear comprising certain features described herein and recited in the claims. In particular, although the following Detailed Description discusses exemplary embodiments in the form of footwear such as running shoes, jogging shoes, tennis, squash or racquetball shoes, basketball shoes, sandals and flippers, the disclosures herein may be applied to a wide range of footwear or possibly other kinds of articles.

For consistency and convenience, directional adjectives are employed throughout this Detailed Description corresponding to the illustrated embodiments. The term "longitudinal direction" as used throughout this detailed description and in the claims refers to a direction extending from heel to toe, which may be associated with the length, or longest dimension, of an article of footwear such as a sports or recreational shoe. Also, the term "lateral direction" as used throughout this Detailed Description and in the claims refers to a direction extending from side to side (lateral side and medial side) or the width of an article of footwear. The lateral direction may generally be perpendicular to the longitudinal direction. The term "vertical direction" as used with respect to an article of footwear throughout this Detailed Description and in the claims refers to the direction that is normal to the plane of the sole of the article of footwear. Moreover, the vertical direction may generally be perpendicular to both the longitudinal direction and the lateral direction.

The term "sole" or "sole structure" as used herein shall refer to any combination that provides support for a wearer's foot and bears the surface that is in direct contact with the ground or playing surface, such as a single sole; a combination of an outsole and an inner sole; a combination of an outsole, a midsole and an inner sole, and a combination of an outer covering, an outsole, a midsole and an inner sole.

In the various Figures and depictions, the article and components of the article are formed to accommodate a right foot. It should be recognized, however, that the same general structure may be formed to accommodate a left foot or a right foot.

In some embodiments, components of an article of footwear may be formed and/or tooled in a planar or two-dimensional orientation to assist with ease of manufacturing, assembly, and transport. Additionally, using predetermined connection points between various portions of a knitted component may further assist with ease of manufacture, as well as reduce waste from cutting. Further, forming a largely invisible seam may be helpful for aesthetic purposes as well as to eliminate uncomfortable junctions of various portions in an article of footwear to provide increased comfort to a wearer.

In some embodiments, portions of a knitted component may be connected by extending a joining thread between portions of the knitted component at predetermined areas in a first orientation. The pre-connected knitted component may be arranged in a two-dimensional orientation. Additionally, portions of the knitted component may be largely independent of one another. When the joining thread is subjected to tensile force, however, the knitted component may form a three-dimensional structure or a second orientation. Aspects of a joining thread being used to form a seamless abutment are described in detail below.

Referring to FIGS. 1-5, knit structure 100 is depicted in various configurations. Knit structure 100 may be formed using knit element 102. Knit element 102 is formed from at least one yarn that is manipulated (e.g., with a knitting machine) to form a plurality of intermeshed loops that define a variety of courses and wales. That is, knit element 102 has the structure of a knit textile.

Knit structure 100 includes courses and wales. As depicted, knit structure includes three courses and three wales, course 170, course 172 and course 174 and wale 171, wale 173 and wale 175. In should be recognized that knit structure 100 is used as a representative and more or fewer courses and wales may be incorporated into a knit structure. Course 170 includes loop 160, loop 161, and loop 162. Course 172 includes loop 163, loop 164, and loop 165. Course 174 includes loop 166, loop 167, and loop 168.

Each loop includes a head, a leg and a foot. Referring in particular to loop 163, head 150 intermeshes with loop 160 of course 170. In this configuration, head 150 passes behind loop 160, however in other configurations, head 150 may pass in front of loop 160. Loop 163 also includes two legs, leg 152 and leg 154. Leg 152 and leg 154 extend from head 150 towards loop 166. As shown, leg 152 and leg 154 pass in front of the head of loop 166. In other embodiments, leg 152 and leg 154 may pass behind the head of loop 166. As shown, foot 156 and foot 158 pass behind loop 166. In other embodiments, foot 156 and foot 158 may pass in front of head of loop 166. Therefore, loop 163 is interlooped with loop 160 and loop 166. The other loops within each of the courses may be similarly interlooped with one another.

Loops may be separated by various distances along each of the wales in knit structure 100. The distance between the feet of the loops along the wale direction may be used as representative of the distance between loops. Additionally, the distance between the feet of the loops along the wale direction may determine the size of each of the loops. For example, distance 130 extends from foot 146 of loop 160 to foot 156 of loop 163. Distance 130 may be considered the distance between loop 160 and loop 166. Additionally, because loop 163 extends between loop 160 and loop 166, distance 130 may be used in reference to the size of loop 163.

As shown, loops of course 170 and loops of course 174 may be secured on either end. As utilized herein, "secured" when referring to courses or a knit structure means that by pulling a strand or thread of a course within a knit structure, the loops of the course will not greatly deform. Additionally, if the loops do deform when subjected to a force, the loops return to substantially the same shape as before being subjected to a force. For example, foot 146 of loop 160 may extend on to another loop. Additionally the foot of loop 162 may extend on to another loop. In this manner, course 170 and course 174 may be secured. Because the other loops may hold each other in place, and there is no free end of course 170 and course 174, course 170 and course 174 may be secured.

In some embodiments, a single yarn may be used to form various portions of a knit structure. For example, course 170 and course 174 may be formed from a single yarn 106. In other embodiments, a separate, secured yarn may form course 170 and a separate, secured yarn may form course 174. In other embodiments, various courses may extend between course 170 and course 174 (not shown).

In some embodiments, course 170 and course 174 may be formed of unitary knit construction. Unitary knit construction, as utilized herein, defines being formed as a one-piece structure through a knitting process. A unitary knit construction may be used to form a knitted component having structures or elements that include one or more courses of yarn, strands, or other knit material that are joined such that the structures or elements include at least one course in common (i.e., sharing a common yarn) and/or include courses that are substantially continuous between each of the structures or elements. With this arrangement, a one-piece element of unitary knit construction is provided. Therefore, course 170 and course 174 may interact with each other, directly or indirectly, by other means in addition to the interaction by course 172. For example, in some embodiments, course 170 and course 174 may be formed from a single yarn 106.

In some embodiments, joining thread 140 may form course 172. Joining thread 140 may interact with the loops of course 170 as well as the loops of course 174. Joining thread 140 may be unsecured at one end of joining thread 140. For example, joining thread 140 may not pass onto another loop adjacent to loop 163 or loop 165. That is, joining thread 140 may have free-hanging portions that do not continue to interloop with additional parts of a knitted component or knit structure. In some embodiments, one end may be unsecured, while in other embodiments, both ends may be unsecured. As shown, end 142 may be secured while end 144 may be unsecured.

In some embodiments, a joining thread may be a separate or distinct thread from the yarn or thread used to form other courses. For example, course 170 and course 174 may be formed from the same thread or yarn, however joining thread 140 may be formed from a separate yarn.

The yarn used to form knit structure 100 may be formed from various materials. Further, joining yarn 140 may be formed from various types of yarn that impart different properties. Additionally, the other courses of knit structure 100 may be formed from a yarn or thread that is composed of a particular material in order to impart specific properties to a knit structure or knitted component. The properties that a particular type of yarn will impact to a particular area depend on upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high durability. In addition to materials, other aspects of the yarns selected may affect the properties of a joining thread. For example, a monofilament yarn or multifilament yarn may be used. The yarn may also include separate filaments that are each formed of different materials. In addition, the yarn may include filaments that are each formed of two or more different materials, such as a bicomponent yarn with filaments having a sheath-core configuration or two halves formed of different materials. Different degrees of twist and crimping, as well as different deniers may also affect the properties of a yarn. In some embodiments, a yarn or thread utilized in joining thread 140 may have a low friction coefficient. This may allow for joining thread 140 to translate through courses without stopping or snagging as joining thread 140 is subjected to a tensile force.

Figure 2:
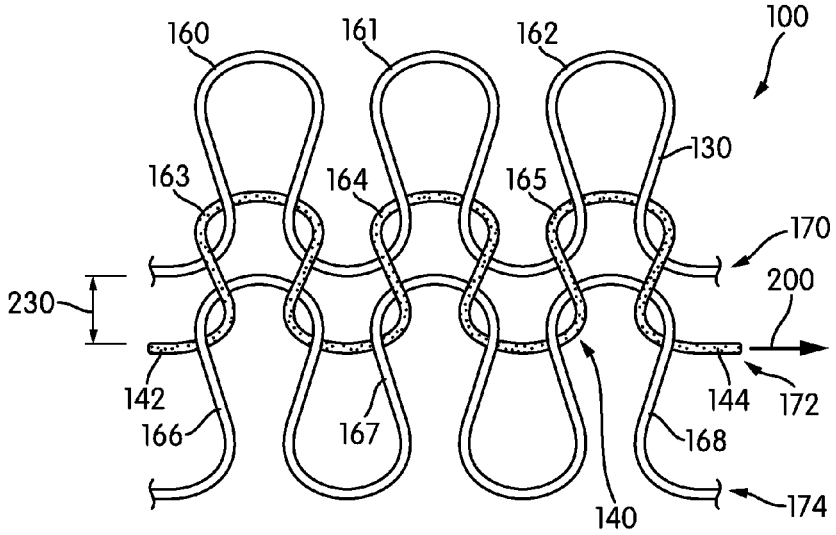
FIG. 2 is a representational view of an exemplary embodiment of a knit structure incorporating a joining thread that is subjected to a tensile force.

In some embodiments, knit structure 100 may include means for changing the distance between loops. Referring to FIGS. 1-5, end 142 of joining thread 140 forming loop 163 may be secured in some manner. For example, end 142 may be held, knotted, sewn, stapled, fastened or the like such that end 142 remains substantially stationary. That is, end 142 may not translate along the course direction. End 144 may remain unsecured. That is, end 144 may be free laying and not continuous with another course. A tensile force 200 may be exerted on end 144 of joining thread 140, as shown in FIG. 2. As joining thread 140 is pulled, the distance between loops along each of the wales decreases. For example, distance 230 is smaller than distance 130. Tensile force 200 pulls joining thread 140 through both course 170 and course 174. As joining thread 140 is pulled, the legs of the loops in course 172 begin to shrink. The thread from the legs of loop 163, loop 164 and loop 165 is transferred throughout course 172 and eventually allows for end 144 to be pulled away from knit structure 100. As joining thread 140 is pulled, the loops within course 172 begin to flatten due to the length of the legs of each of the loops being transferred toward end 144. As joining thread 140 continuous to be pulled through the loops of course 170 and course 174, joining thread 140 may eventually flatten such that joining thread 140 may appear as a straight line.

Figure 3:
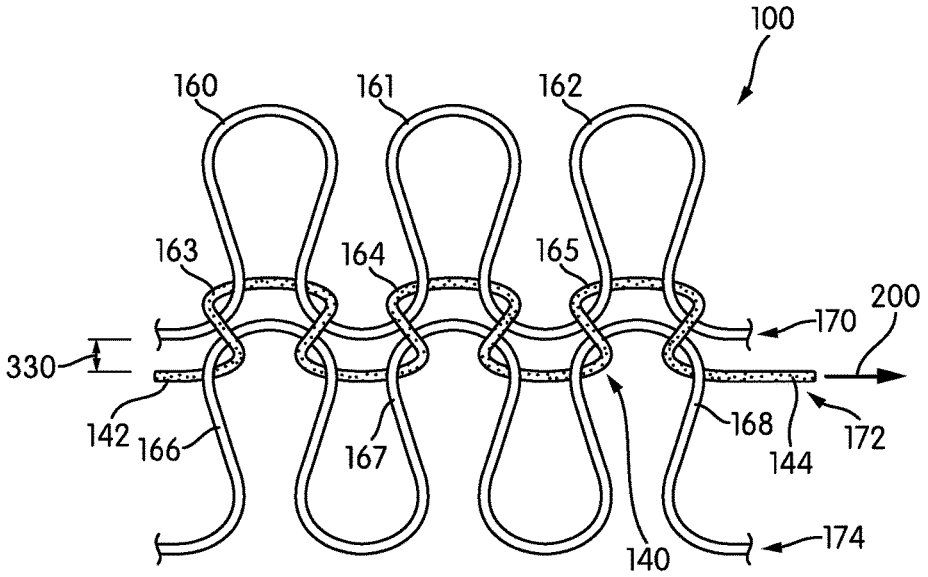
FIG. 3 is a representational view of an exemplary embodiment of a knit structure incorporating a joining yarn that is subjected to a tensile force.
Figure 4:
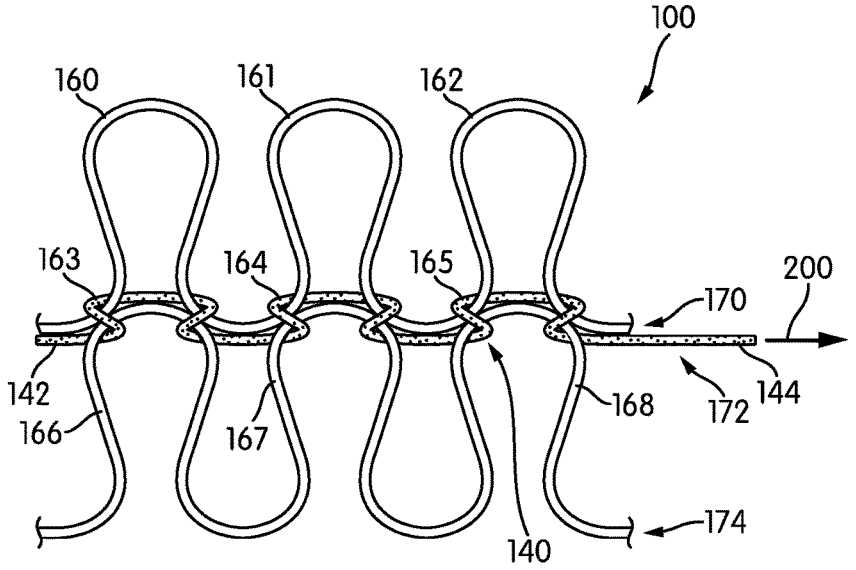
FIG. 4 is a representational view of an exemplary embodiment of a knit structure incorporating a joining thread that is subjected to a tensile force.

As end 144 is pulled, the loops within course 170 and course 174 become closer to each other. As shown in FIG. 3, distance 330 is smaller than distance 230. In FIG. 4, the distance between course 174 and course 170 is negligible. As shown in FIG. 4, the distance has been reduced such that the loops of course 174 and course 170 are adjacent to or in contact with one another.

Referring in particular to FIG. 4, knit structure 100 may appear as a knit structure with only two courses as opposed to three. Because joining thread 140 is pulled in a substantially straight line, the visibility of joining thread 140 may be reduced. Additionally, the loops of course 174 may appear to be in the same position that loops of course 172 were before joining thread 140 was subjected to a tensile force. That is, loops of course 174 may appear to be directly intermeshed and interlooped with loops of course 170. Although the loops of course 174 may not directing intermesh with the loops of course 170, the heads of each of the loops of course 174 may be located in substantially the same space as the heads of the loops of course 172. As such, it appears as though the loops of course 174 interloop with the loops of course 170. By pulling course 174 toward course 170 (or vice versa), an apparent seamless connection between course 174 and course 170 is formed.

Figure 5:
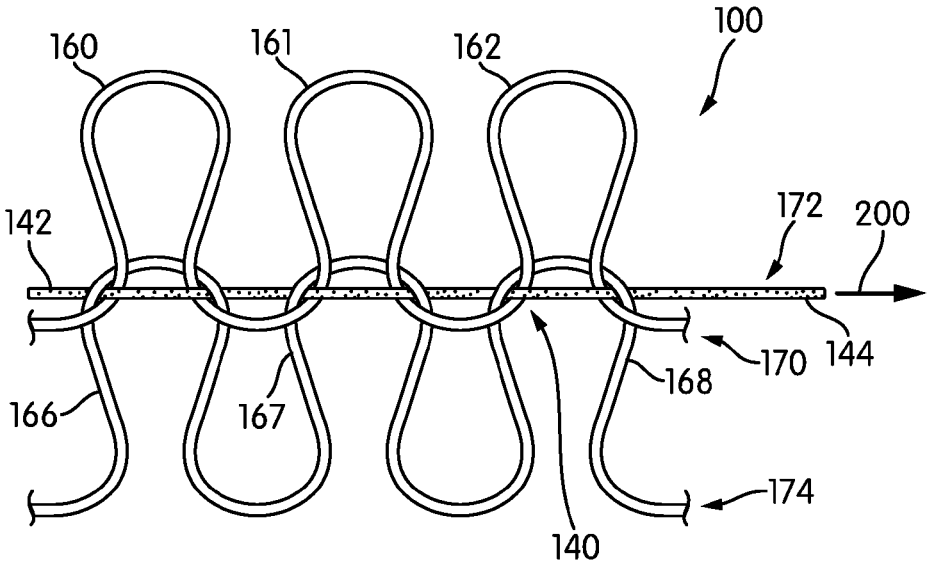
FIG. 5 is a representation view of an exemplary embodiment of a joined knit structure incorporating a joining thread.

Referring to FIG. 5, joining thread 140 has been tensioned such that joining thread 140 appears as a straight or unbent line. As joining thread 140 continues to be pulled or tensioned, the loops within course 170 and the loops of course 174 may overlap. In some embodiments, the lower portion of loop 160, loop 161, and loop 162 may extend over a portion of loop 166, loop 167, and loop 168. In this configuration, tensile force 200 has pulled joining thread 140 such that loop 163, loop 164, and loop 165 are no longer visible. The legs and heads of the loops of joining thread 140 have been diminished such that in some embodiments, the loops of joining thread 140 may no longer be present. That is, the legs of the loops and the head of the loops may be located in the same plane such that the distances between the heads of the loops and the feet of the loops are indiscernible or negligible. By tensioning joining thread 140 to a largely linear orientation, the loops of course 170 and the loops of course 174 may be more tightly or securely connected than in previous configurations. Further, in this configuration, joining thread 140 may be obscured from view by different portions of course 170 and course 174. This type of connection may be used in other configurations as discussed in the Detailed Description.

Additionally, by using a joining thread, small portions of the knit structures may overlap, which may reduce bulkiness as compared to other configurations. In other embodiments, the knit structures may be joined or abutted without an overlapping of knit elements. This configuration may further reduce bulkiness in the area of the seam which may increase comfort when used in an article of footwear.

Figure 6:
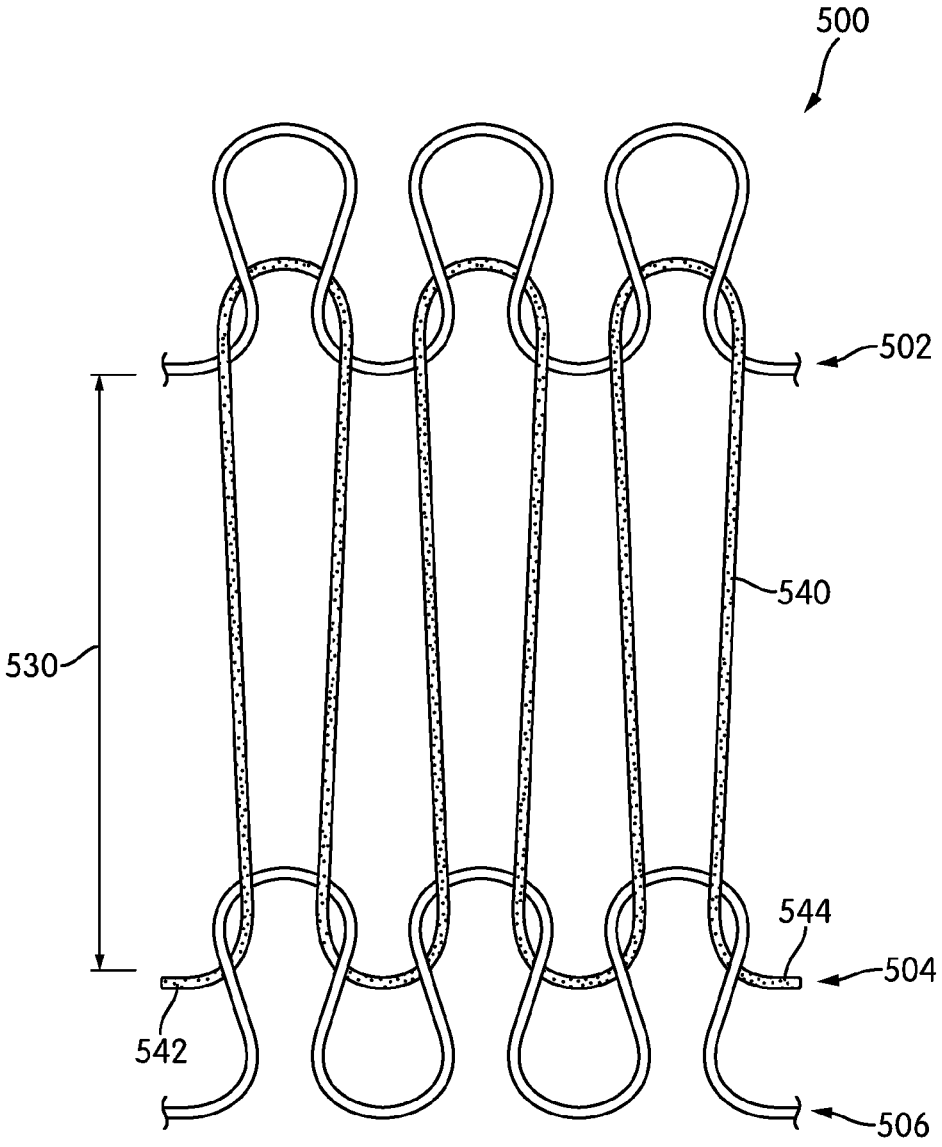
FIG. 6 is a representational view of an alternate embodiment of a knit structure incorporating a joining thread.

Referring to FIG. 6, a configuration of a knit structure is depicted. Knit structure 500 includes course 502, course 504 and course 506. In a similar manner as to knit structure 100 of FIGS. 1-5, course 502 and course 506 may be secured, whereas course 504 may unsecured at the ends. In some embodiments, both ends of course 504 may be unsecured. In the embodiment depicted in FIG. 6, however, end 542 may be secured while end 544 may be unsecured. As shown, distance 530 between loops of course 502 and loops of course 506 is larger than distance 130 of FIG. 1. Knit structure 500 demonstrates that a joining thread may span a large distance. This arrangement may allow other courses and knit structures to be located away from one another.

In some embodiments, different portions of a knit structure may be able to be moved semi-independently from one another. For example, course 502 may be able to be moved toward course 506 without impacting course 506. Due to the length of loops within course 504, course 502 may be able to be moved because slack may be present. It should be recognized that at some point the movement of course 502 may influence course 506. For example, by moving a course from side-to-side the slack of loops between the courses may diminish and pull course 506 or course 502. The distance between course 502 and course 506 may influence the distance that either course may be able to move without impacting the location of the other course. For example, the smaller the distance between course 502 and course 506, the less each course may be moved without impacting the other course. Additionally, in some embodiments, the ability to move different portions of a knit structure may allow for different portions of the knit structure to be located in various orientations. For example, some portions of the knit structure may be located at a forty-five degree angle with respect to the other portion of the knit structure. In other embodiments, different portions of the knit structure may be located at different elevations. This may allow for different portions of a knitted component or knit structure to be tooled or printed upon without interfering with another portion of the knit structure. As in FIGS. 1-5, joining thread 540 may be subjected to a tensile force and form a structure similar to knit structure 100 shown in FIG. 5.

Figure 7:
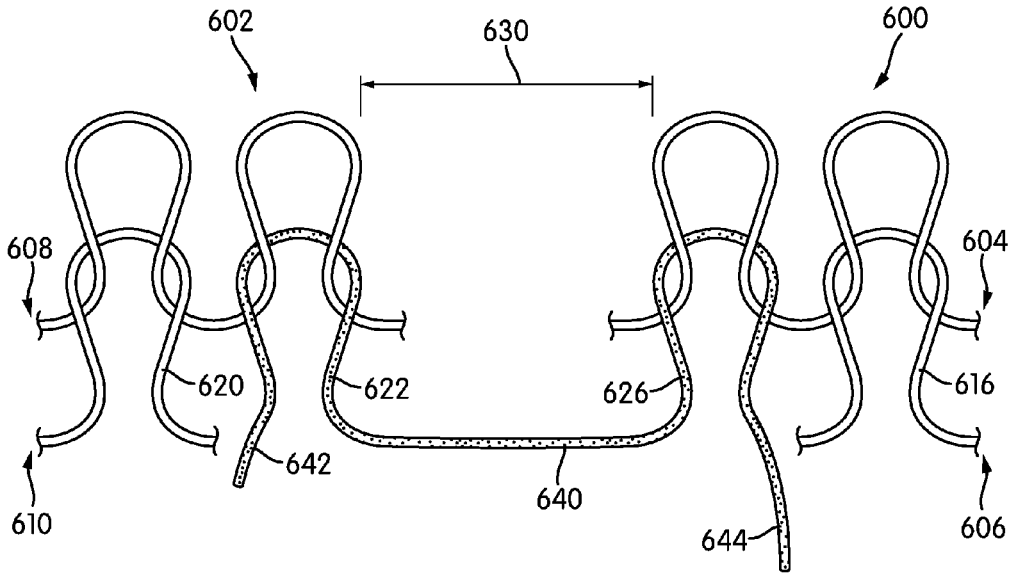
FIG. 7 is a representational view of an embodiment of multiple knit structures and a joining thread.

In some embodiments, a joining thread may be utilized in order to bring the loops of the courses closer together along the course direction. This arrangement is in contrast to the embodiments shown in FIGS. 1-6 which generally depict a joining thread bringing courses closer together along the wale direction. FIG. 7 depicts two knit structures, knit structure 600 and knit structure 602 separated by a distance 630. In some embodiments, knit structure 600 and knit structure 602 may be of unitary knit construction. In other embodiments, knit structure 600 and knit structure 602 may be separate knit structures. Knit structure 600 includes two secure courses, course 604 and course 606. Similarly, knit structure 602 includes two secure courses, course 608 and course 610. Joining thread 640 may extend between knit structure 600 and knit structure 602. In some embodiments, joining thread 640 may interact with a loop from course 608 as well as a loop from course 604. Additionally, joining thread 640 may align along the course direction between course 610 and course 606. As shown, joining thread 640 forms a loop 622 that is located adjacent loop 620 of course 610. Additionally, loop 626 is located adjacent to loop 616 of course 606. Accordingly, joining thread 640 may appear as a continuous course with both course 610 and course 606.

Figure 8:
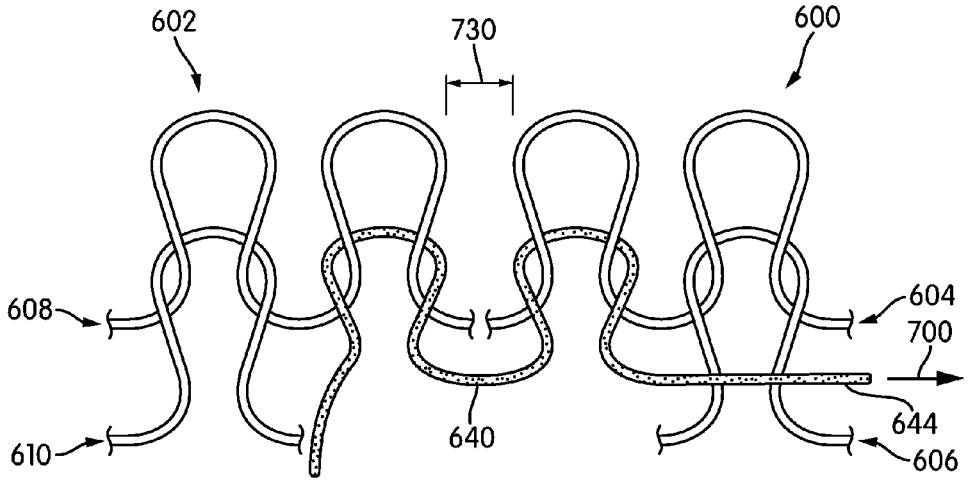
FIG. 8 is a representational view of the knit structures of FIG. 7 with the joining thread being subjected to a tensile force.

As with joining thread 140, joining thread 640 may be unsecured on at least one end. For example, end 642 is secure while end 644 remains unsecured. As end 644 of joining thread 640 is subjected to a tensile force 700 (see FIG. 8), knit structure 600 and knit structure 602 may move toward one another. Distance 730 between knit structure 600 and knit structure 602 may be smaller than distance 630. As joining thread 640 continues to be tightened the space between knit structure 600 and knit structure 602 may lessen until knit structure 600 and knit structure 602 may contact each other or abut to one another. In this configuration, course 608 and course 604 may appear to be formed from one continuous strand. Additionally, in some embodiments, joining thread 640 may appear as a straight line and may be obscured by other loops within each of the knit structures.

Because knit structure 600 and knit structure 602 may be separated by a space before joining thread 640 is subjected to a force, different actions or processes may be taken or performed with respect to knit structure 600 and knit structure 602. For example, in some embodiments, knit structure 600 may be subjected to a dyeing or printing process while knit structure 602 is subjected to a tooling process. Additionally, each of the processes may be done while knit structure 600 and knit structure 602 are in flat orientations. This configuration may allow for greater ease in performing the actions as well as a higher efficiency in completing the processes as compared to actions taken with the knit structures in a three-dimensional orientation.

Figure 9:
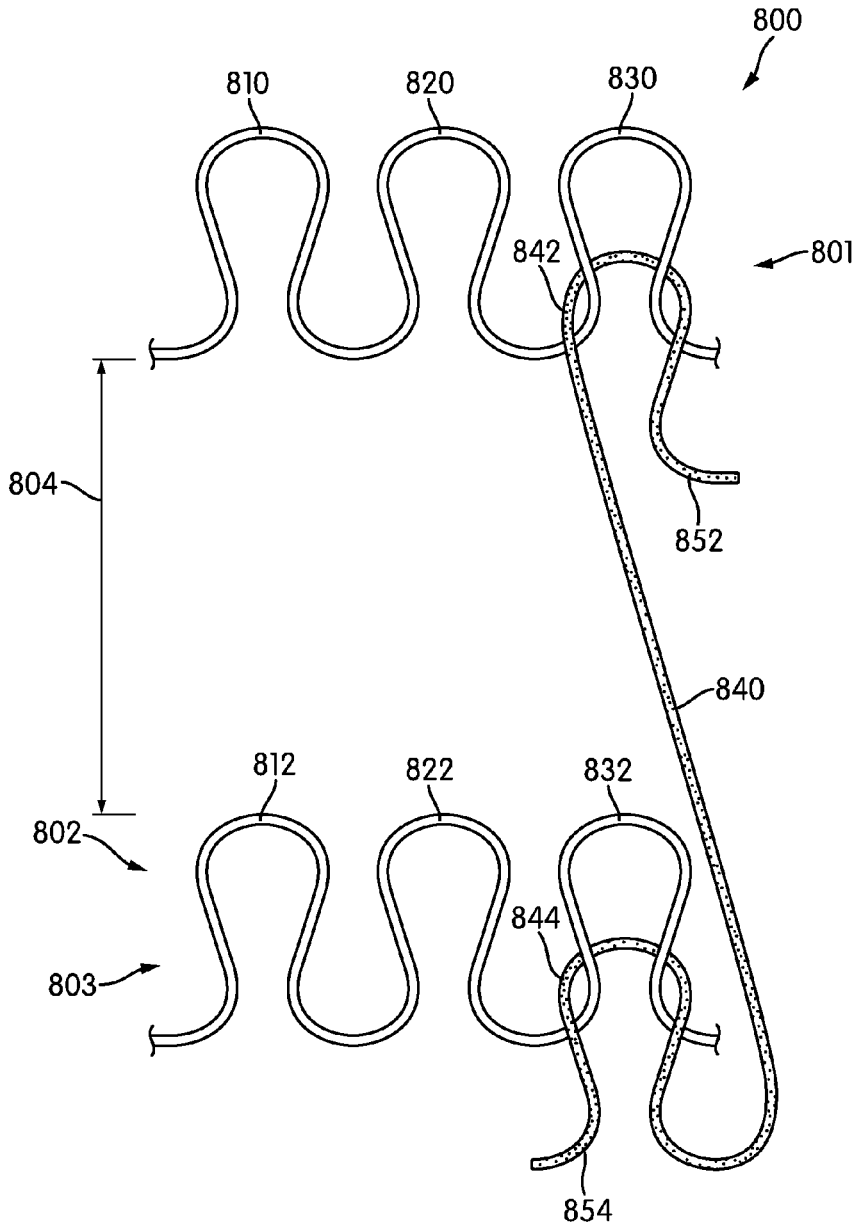
FIG. 9 is a representational view of an alternate embodiment of multiple knit structures and a joining thread.
Figure 10:
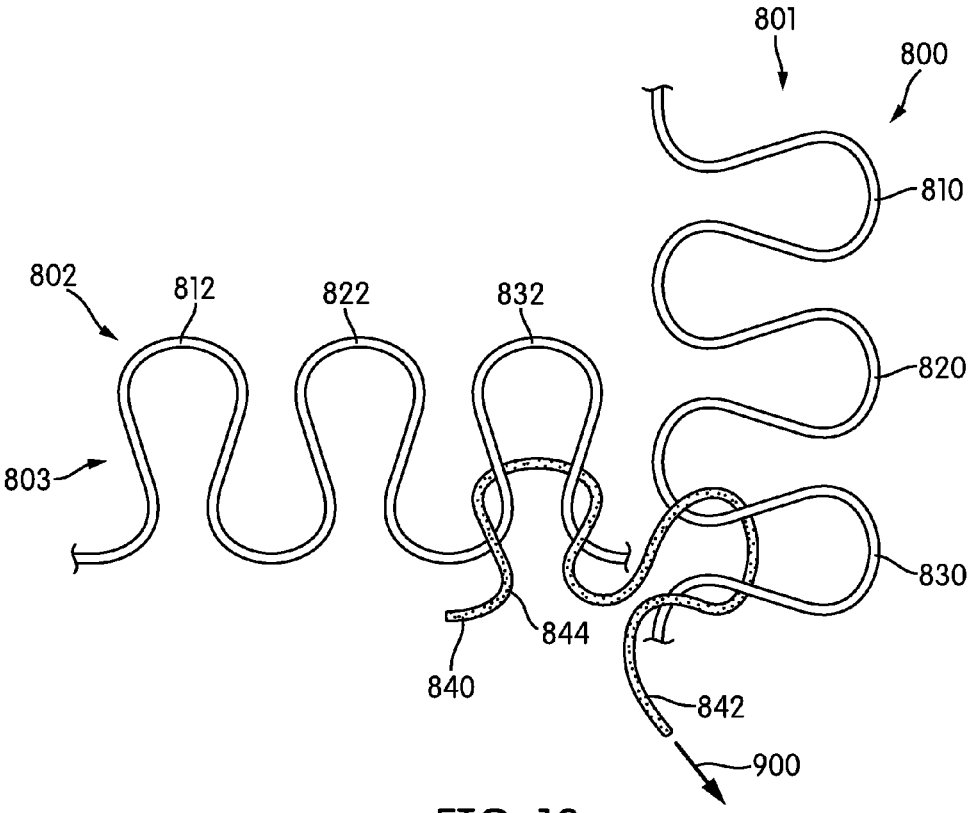
FIG. 10 is a representational view of the knit structures of FIG. 9 with the joining thread being subjected to a tensile force.

Referring to FIGS. 9 and 10, another embodiment of knit structures utilizing a joining thread is shown. In this embodiment, the courses of knit structure 800 and knit structure 802 are oriented largely parallel to one another; however, knit structure 800 and knit structure 802 are separated by distance 804. Knit structure 800 may include course 801 which is secured, while knit structure 802 includes course 803 which is secured. Course 801 includes loop 810, loop 820, and loop 830. Course 803 may include loop 812, loop 822, and loop 832.

As with previous embodiments, in the embodiment shown in FIGS. 9 and 10, knit structure 800 and knit structure 802 may be of unitary knit construction. In some embodiments, knit structure 800 and knit structure 802 may be formed using a single yarn. In other embodiments, knit structure 800 and knit structure 802 may not be formed of unitary knit construction. That is, in some embodiments, knit structure 800 and knit structure 802 may be formed from separate knit constructions.

In the configuration of FIG. 9, knit structure 800 and knit structure 802 may be subjected to various processes including dyeing, tooling, printing or other processes. Each knit structure may be able to be subjected to a process independently from one another. Additionally, each process may be initiated while each knit structure is in a flat two-dimensional orientation. Working on a knit structure while the knit structure is in a flat orientation may provide benefits over working on a knit structure while the knit structure is in a three-dimensional orientation.

In some embodiments, joining thread 840 may extend between knit structure 800 and knit structure 802. Joining thread 840 may interact with a loop from a first course and a loop from a second course. For example, joining thread 840 interacts with loop 830 of course 801 and joining thread 840 interacts with loop 832 of course 803. In some embodiments, at least one end of joining thread 840 may be unsecured. In other embodiments, both ends of joining thread 840 remain unsecured. As shown, end 854 may be secured while end 852 may be unsecured.

Referring to FIG. 10, end 852 of joining thread 840 is subjected to force 900. As joining thread 840 is pulled, the space between knit structure 800 and knit structure 802 decreases. Additionally, knit structure 800 may begin to rotate as loop 842 of joining thread 840 aligns with loop 844 of joining thread 840. As shown in FIG. 10, loop 844 and loop 842 are located substantially adjacent to one another. Additionally, course 801 is located adjacent to course 803, however, course 801 may no long be parallel to course 803. Due to the location of the interaction of loop 842 within course 801 (at loop 830), as well as the location of loop 844 within course 803 (at loop 832), as joining thread 840 is tensioned course 801 may rotate. If, as in another embodiment, loop 842 interacted with loop 810, course 801 may not rotate but instead loop 810 may be located adjacent to loop 832. Additionally, in such an embodiment, course 801 may be located adjacent and parallel to course 803. Such a configuration would be similar to the knit structures depicted in FIGS. 7 and 8. By locating loops of joining thread 840 in particular locations in the knit structures, a specific rotation of each knit structure may be achieved. Likewise, various shapes, designs, and course locations may be configured by particularly locating a joining thread in particular areas within a knit structure.

Figure 11:
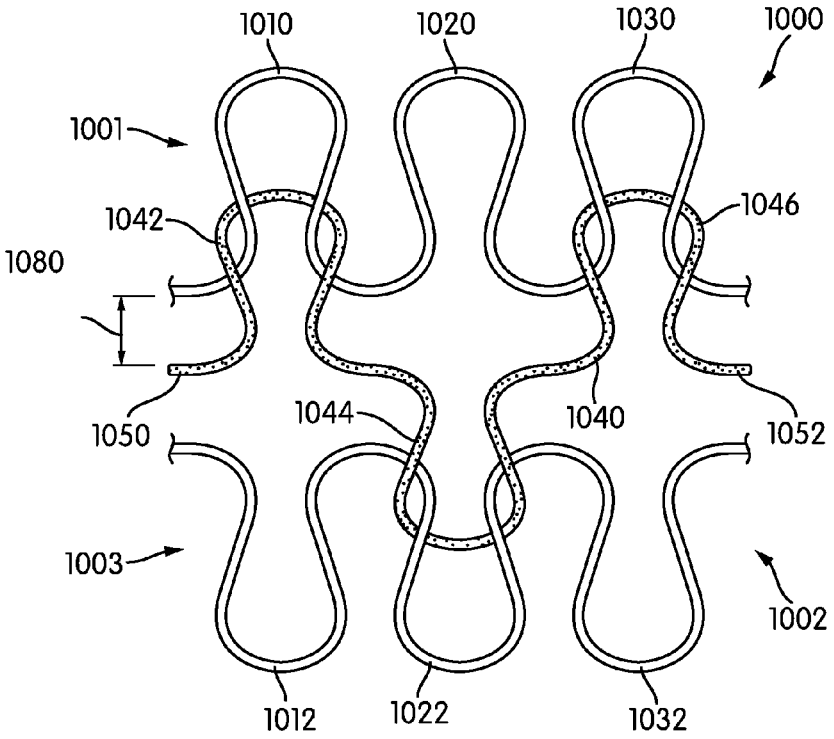
FIG. 11 is a representational view of another alternate embodiment of multiple knit structures and a joining thread.
Figure 12:
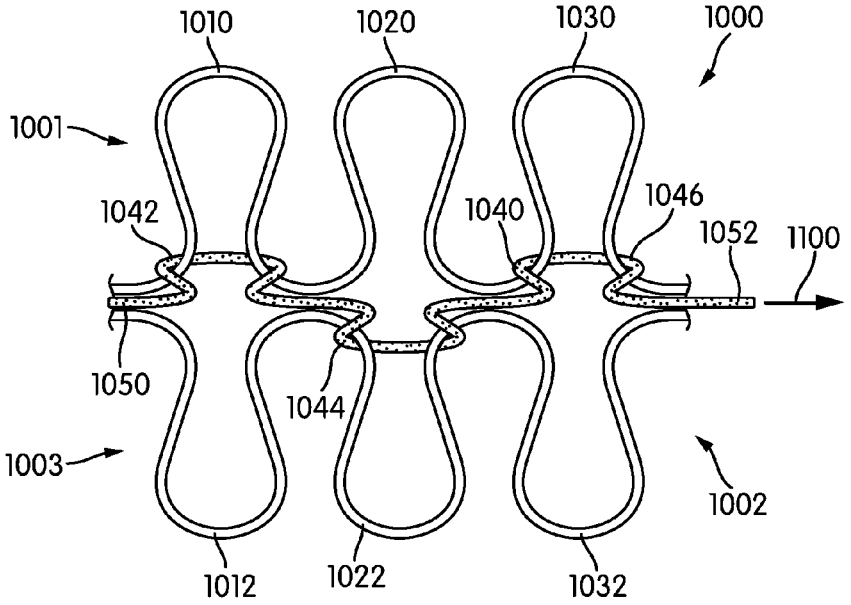
FIG. 12 is a representational view of the knit structures of FIG. 11 with the joining thread being subjected to a tensile force.

Referring to FIGS. 11 and 12, another embodiment of knit structures utilizing a joining thread is depicted. Knit structure 1000 and knit structure 1002 are oriented away from one another and separated by a distance 1080. That is, knit structure 1000 and knit structure 1002 are essentially mirror images of one another along a dividing line that runs parallel to course 1001 and course 1003. Additionally, in some embodiments, knit structure 1000 and knit structure 1002 may be formed of unitary knit construction.

Knit structure 1000 includes course 1001 which includes loop 1010, loop 1020, and loop 1030. Knit structure 1002 includes course 1003 which includes loop 1012, loop 1022, and loop 1032. Each course may be secured in a similar manner as discussed in relation to previous embodiments. As shown, joining thread 1040 extends between course 1001 and course 1003. Loop 1042 interacts with loop 1010 of course 1001, and loop 1046 interacts with loop 1030 of course 1001. Additionally, loop 1044 interacts with loop 1022 of course 1003. The loops of joining thread 1040 therefore extend in different directions. In some embodiments, at least one end of joining thread 1040 may be unsecured.

In some embodiments, both ends of joining thread 1040 may be unsecured. As shown in FIGS. 11 and 12, end 1050 is secured while end 1052 remains unsecured.

Referring to FIG. 12, tensile force 1100 may act upon end 1052 causing joining thread 1040 to pull knit structure 1000 and knit structure 1002 together. The distance between knit structure 1000 and knit structure 1002 may diminish such that knit structure 1000 and knit structure 1002 may appear to be directly intermeshed with one another. In similar fashion to the embodiment shown in FIGS. 1-5, joining thread 1040 may substantially straighten such that joining thread 1040 may be substantially obscured from view when tightened. The legs of the loops within joining thread 1040 translate through loops of course 1001 and course 1003. The length of legs and heads of the loops of joining thread 1040 may transfer toward end 1052 allowing for end 1052 to extend away from knit structure 1000 and knit structure 10002. Such a configuration may allow for knit structures in different orientations to be joined together with ease. Additionally, the configuration of FIGS. 11 and 12 may allow for each knit structure to be tooled, dyed, printed upon or subjected to other processes substantially independently from the other knit structure.

In each of the embodiments discussed previously, it should be recognized that different knit structures may be utilized. For example, each knit structure need not utilize a plain jersey knit structure. Additionally, each joining thread may join particular loops of one knit structure to other loops of a separate knit structure. For example, some loops of a knit structure may not interloop with a joining thread. Loop 1020, for example, does not interloop with joining thread 1040. In other embodiments, various loops of a knit structure also may not interact with a joining thread.

In each of the embodiments previously discussed the knit structures may be secured after the joining thread has been subjected to a force. In some embodiments, the free end of the joining thread may be sewn, knit, bonded, tacked, or otherwise secured after the desired quantity of tension has been applied. This may lock the knit structures in place such that the joining thread may resist a force to separate the knit structures from one another.

Referring to FIGS. 13-17 a knitted component is depicted utilizing a joining thread. As depicted, knitted component 1200 is formed in a largely rectangular shape. Knitted component 1200 includes a first side 1201 and a second side 1202 that is substantially perpendicular to first side 1201. Additionally, knitted component 1200 includes a third side 1203 that is substantially perpendicular to second side 1202 as well as parallel to first side 1201. Further, knitted component 1200 includes a fourth side 1204 which is substantially parallel to second side 1202 and is substantially perpendicular to first side 1201 and third side 1203. As such, knitted component 1200 is largely rectangular. In other embodiments, various different shapes may be utilized.

In some embodiments, a joining thread may be pre-positioned to interact with knitted component 1200 in a predetermined manner. As shown, joining thread 1240 may be pre-positioned in order to interact with particular loops within knitted component 1200 in a predetermined manner. In some embodiments, joining thread 1240 may be located on a knitting machine. That is, in some embodiments, a knitting machine may be programmed such that joining thread 1240 interacts with knitted component 1200 automatically during the knitting process. In other embodiments, joining thread 1240 may be placed on a knitting machine as a knitted component is formed. For example, joining thread 1240 may be located within particular needles in a knitting machine. Joining thread 1240 may then interact with knitted component 1200 as knitted component 1200 is formed on a needle bed.

Joining thread 1240 may be arranged to interact with particular loops and particular points within knitted component 1200 in a predetermined manner. As shown, loop 1211 may be arranged to interact with a loop 1210 and point A. Loop 1213 may be arranged to interact with a loop 1212 at point A'. In some embodiments, loop 1210 and loop 1212 may be located substantially the same distance from third side 1203. That is, loop 1210 and loop 1212 may be located directly across knitted component 1200. Loop 1221 may be oriented to interact with loop 1220 at point B. Loop 1223 may be oriented to interact with loop 1222 at point B'. In some embodiments, loop 1220 and loop 1222 may be located substantially the same distance from third side 1203. Loop 1231 may be oriented to interact with loop 1230 at point C. Loop 1233 may be oriented to interact with loop 1232 at point C'. In some embodiments, loop 1230 and loop 1232 may be located substantially the same distance from third side 1203. Loop 1251 may be oriented to interact with loop 1250 at point D. Loop 1253 may be oriented to interact with loop 1252 at point D'. In some embodiments, loop 1250 and loop 1252 may be located substantially the same distance from third side 1203.

In some embodiments, the points of connection may be arranged in various manners. In some embodiments, the points may not be located directly across a knitted component. For example, in some embodiments points may be located diagonally from one another. Additionally, loops of joining thread 1240 may interact with different loops. For example, loop 1213 may interact with loop 1222.

Figure 13:
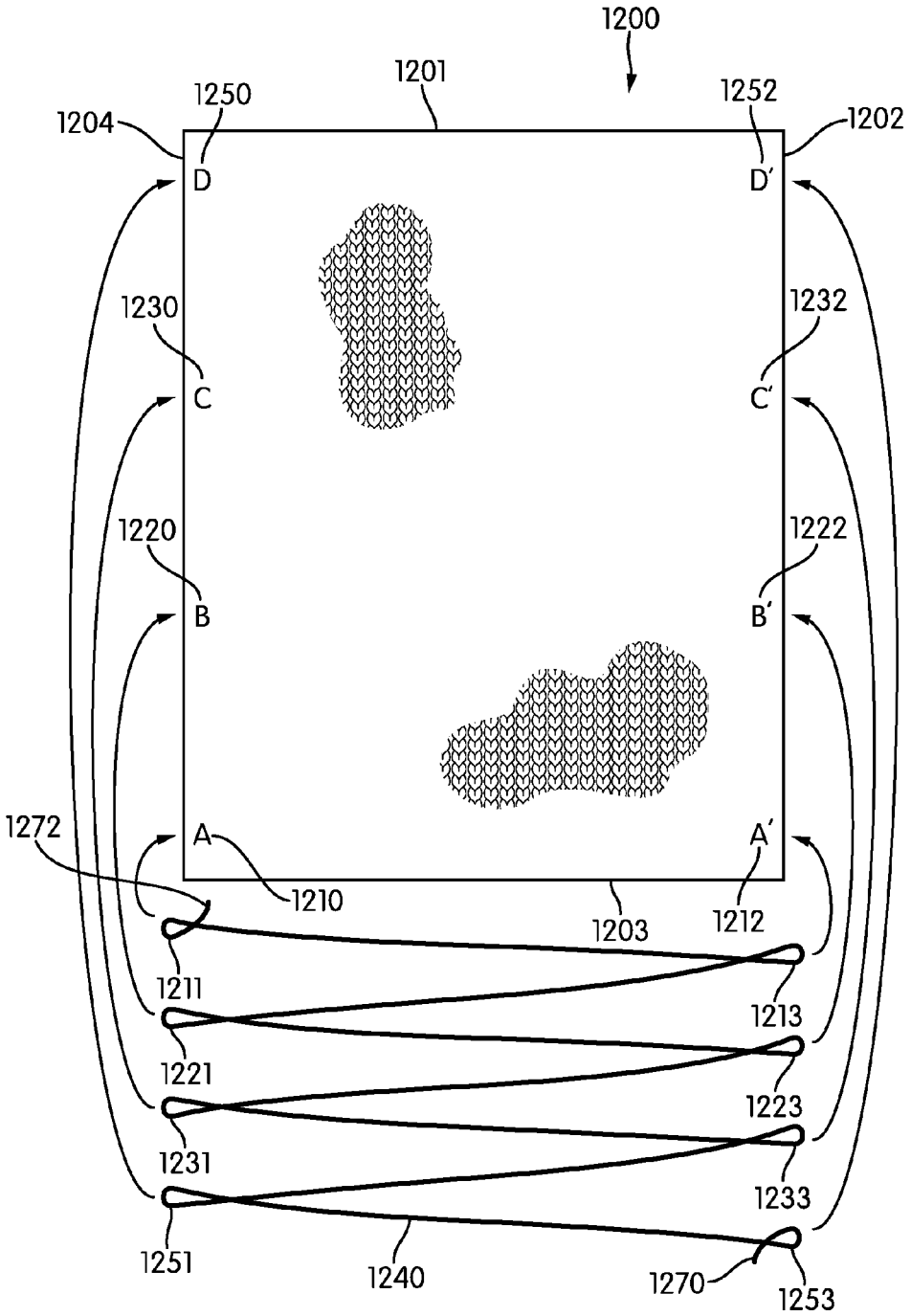
FIG. 13 is a representational view of a joining thread and a knitted component.

In some embodiments, joining thread 1240 may be configured as a knit structure. In some embodiments such as shown in FIG. 13, joining thread 1240 may utilize float loops to extend from one loop to another. For example, between loop 1211 and loop 1213, a float loop may be utilized. In other embodiments, an auxiliary element may be utilized in order to keep joining thread 1240 in a particular orientation and form an auxiliary knitted component. An auxiliary element may be used in order to maintain shape of joining thread 1240 so that parts of joining thread 1240 do not entangle with one another. The auxiliary element may be removed prior to or during tensioning of joining thread 1240. The embodiments described herein can make use of the apparatus, structures or methods described in Podhajny, U.S. Publication No. 2014/0237861 published on Aug. 28, 2014, entitled "Method of Knitting a Knitted Component with a Vertically Inlaid Tensile Element," the entirety of which is hereby incorporated by reference. In Podhajny, an auxiliary element is used during the manufacturing of a knitted component.

In some embodiments, the loops of joining thread 1240 may be particularly located. In some embodiments, the loops of joining thread 1240 may be arranged such that an adjacent loop may be placed across a knitted component. For example, loop 1211 may interact with loop 1210 of knitted component 1200 and loop 1213 may interact with loop 1212 of knitted component 1200. As discussed previously, loop 1210 and loop 1212 may be located approximately across from one another. Additionally, joining thread 1240 may extend directly from loop 1211 to loop 1213. That is, between loop 1211 and loop 1213 there may be no other loops which are configured to interact with knitted component 1200. In this sense, when joining thread 1240 is tensioned, loop 1211 and loop 1213 may be located next to one another.

Figure 14:
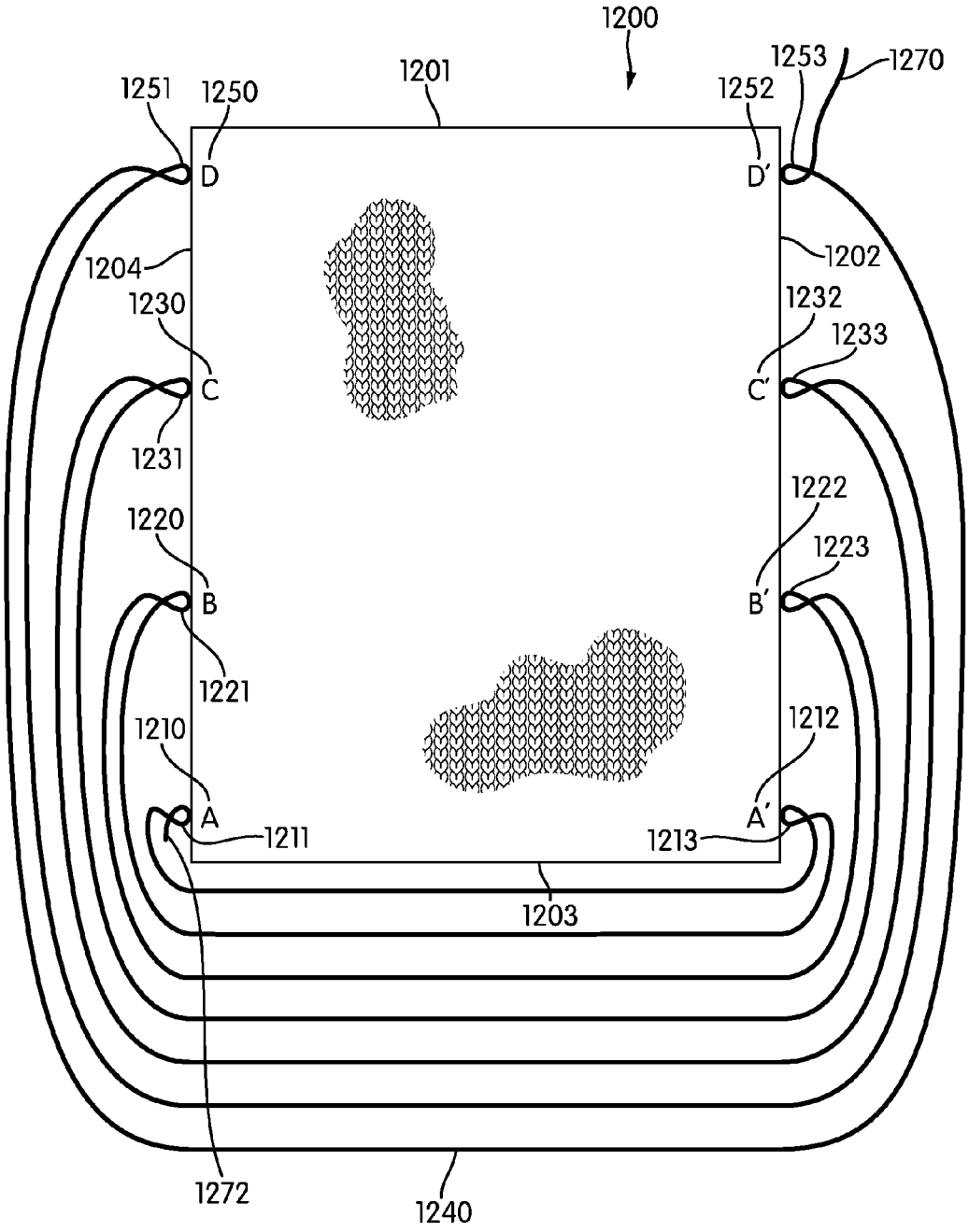
FIG. 14 is a representational view of a joining yarn connected to the knitted component of FIG. 13.

Referring to FIG. 14, each of the loops of joining thread 1240 is shown interacting with loops in knitted component 1200 at the predetermined points previously discussed. Although joining thread 1240 is shown extending below and around knitted component 1200, it should be recognized that in some embodiments, joining thread 1240 may extend across knitted component 1240.

In some embodiments, after interlooping the loops of joining thread 1240 with the loops of knitted component 1240, an end of joining thread 1240 may be secured. In other embodiments, both ends of joining thread 1240 may be unsecured. In other embodiments, end 1272 may be unsecured while end 1270 remains secured.

In configurations as shown in FIG. 14, second side 1202 and fourth side 1204 may be physically connected to one another by joining thread 1240. Although loosely connected, the loops of joining thread 1240 interloop with loops on second fourth side 1204 and fourth side 1204. Further, in this configuration, tooling, dyeing, or other processes may be performed. Knitted component 1200 and joining thread 1240 may also be able to be moved to different locations for additional processes while in a two-dimensional orientation.

Figure 15:
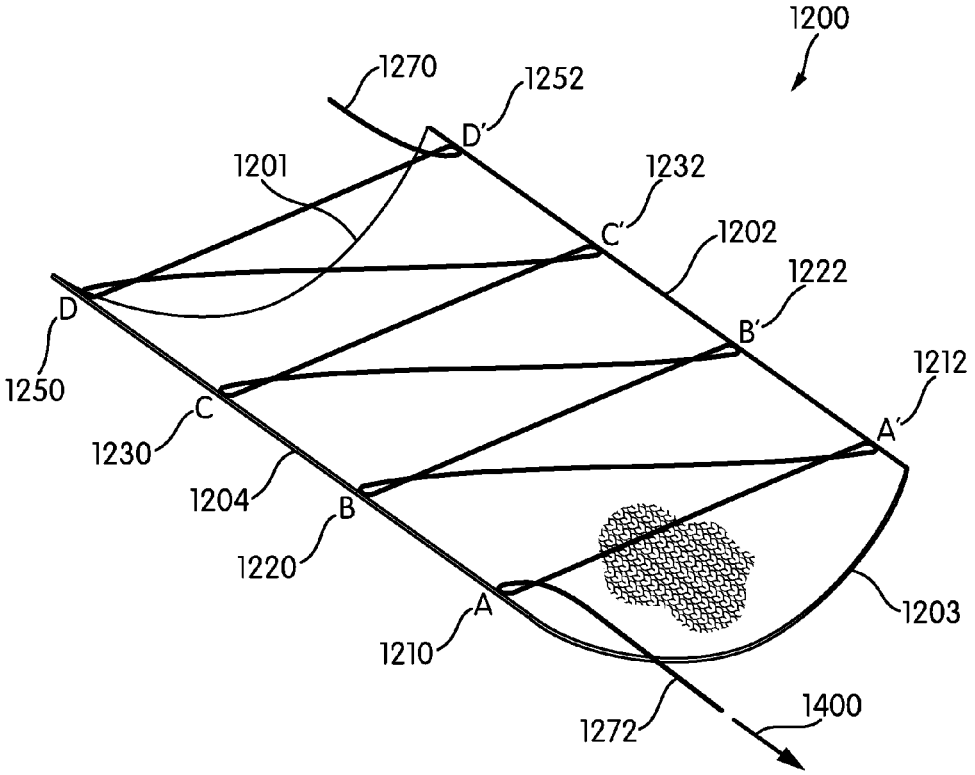
FIG. 15 is an isometric view of the knitted component of FIG. 13 with the joining thread being subjected to a tensile force.

Referring to FIG. 15, an isometric view of knitted component 1200 is depicted. In this Figure, end 1272 of joining thread 1240 is subjected to a tensile force 1400. As joining thread 1240 is subjected to tensile force 1400, knitted component 1200 may begin to curve. The tensile force may be transferred through the joining thread and cause the loops of joining thread 1240 to move toward each other. As joining thread 1240 continues to be pulled, the loops of joining thread 1240 are pulled closer to each other, and therefore the corresponding loops at the points of knitted component 1200 with which joining thread 1240 interloops are also pulled closer to each other. As shown in FIG. 15, knitted component 1200 is changed from a flat, largely two-dimensional structure, to a three-dimensional structure with a shape of a half-cylinder.

Figure 16:
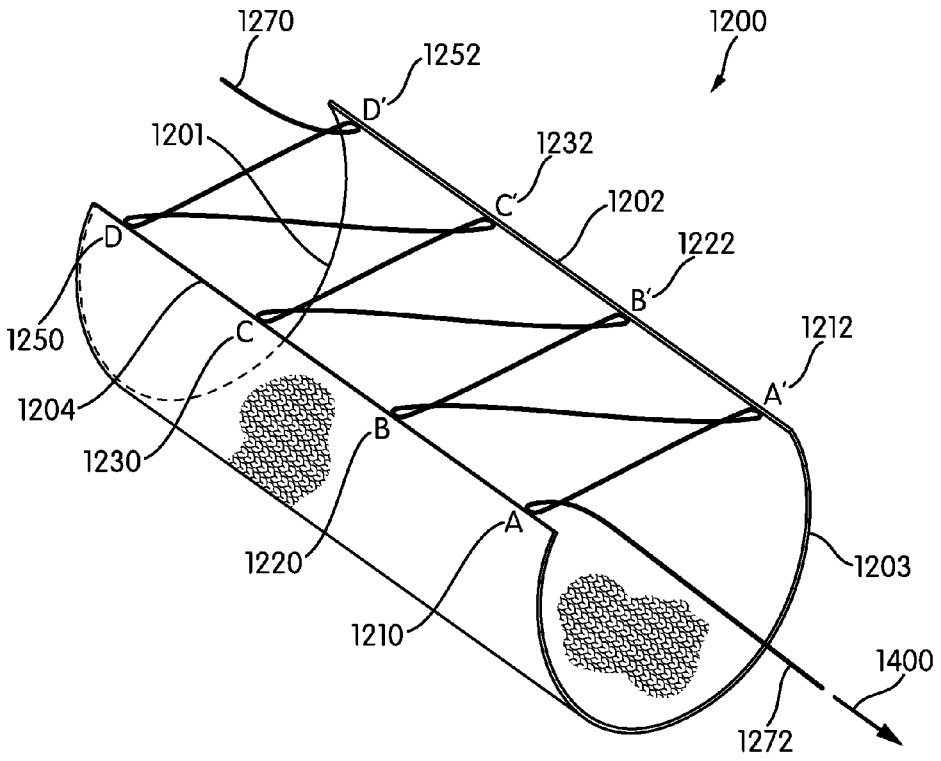
FIG. 16 is an isometric view of the knitted component of FIG. 13 with the joining thread being subjected to a tensile force.

Referring to FIG. 16, end 1272 continues to experience a tensile force. Tensile force 1400 pulls joining thread 1240 through the loops of knitted component 1200. This action extends end 1272 away from knitted component 1200 and brings the predetermined points of knitted component 1200 closer together as the loops of joining thread 1240 also are brought closer together. Knitted component 1200 is transformed into a shape similar to a cylinder. First side 1201 and third side 1203 are curved in a substantially circular manner, while second side 1202 and fourth side 1204 remain substantially linear and parallel.

Figure 17:
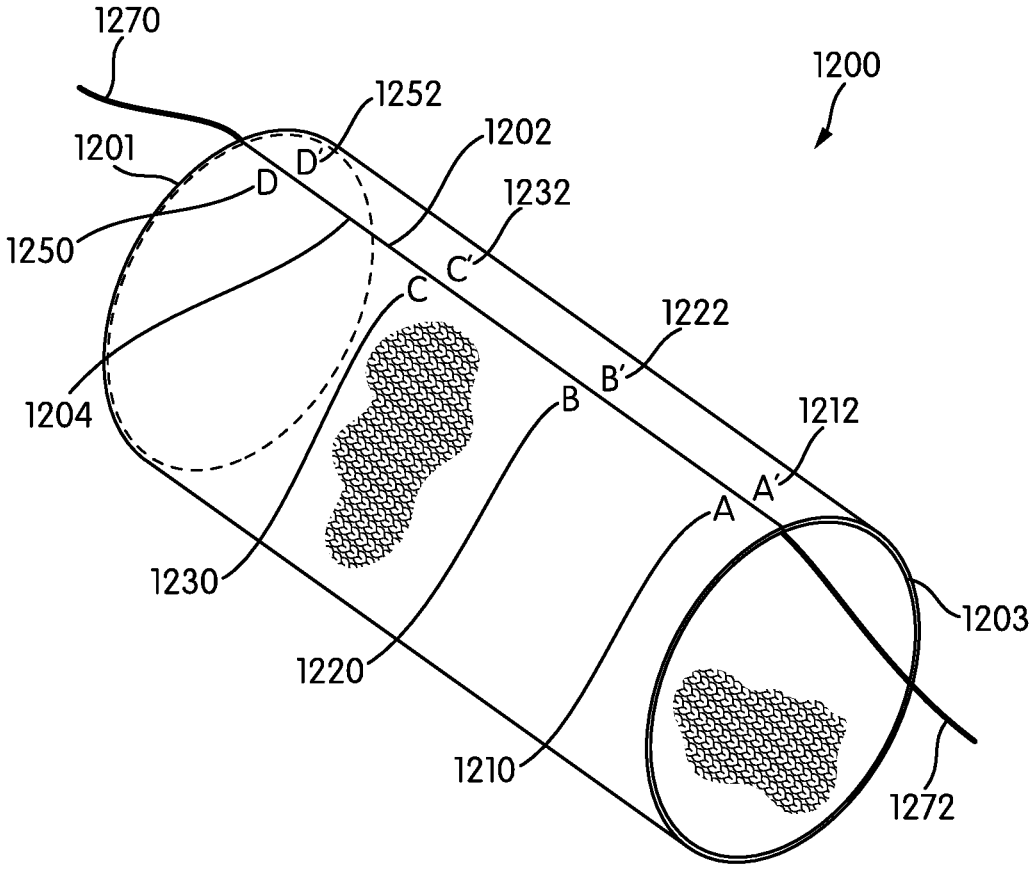
FIG. 17 is an isometric view of the knitted component of FIG. 13 as a three-dimensional article.

Referring to FIG. 17, joining thread 1240 has been pulled such that second side 1202 and fourth side 1204 are located adjacent to one another and abut each other. In this configuration, loop 1210 may be located adjacent to loop 1212; loop 1220 may be located adjacent to loop 1222; loop 1230 may be located adjacent to loop 1232; and loop 1250 may be located adjacent to loop 1252. Loop 1211 and loop 1213 additionally may be located adjacent to one another, in a similar manner as depicted in FIGS. 1-12. Additionally, loop 1221 and loop 1223 may be located adjacent to one another. Loop 1231 and loop 1233 may be located adjacent to one another. Loop 1251 and loop 1253 may be located adjacent to one another.

In some embodiments, corresponding points from either side of a knitted component may abut one another. As shown, point A abuts point A', point B abuts point B', point C abuts point C', and points D abuts point D'. In other embodiments, the interaction of loops may be altered such that different points abut one another. For example, by rearranging the interaction of joining thread 1240 with different loops of knitted component 1200, point A may abut point C'. This arrangement may allow for different shapes and designs of a completed knitted component, while allowing for the knitted component to be attached in a predetermined manner in a two-dimensional configuration.

As depicted in FIGS. 1-12, as joining thread 1240 is tensioned, the loops of joining thread 1240 may flatten or diminish such that joining thread 1240 may appear straight or linear. That is, joining thread 1240 may appear as though joining thread 1240 does not include loops. Further, as discussed previously, in some embodiments, as joining thread 1240 is finally tensioned; joining thread 1240 may be obscured from visibility by the loops of knitted component 1200. Therefore, after joining thread 1240 is fully tensioned, knitted component 1200 may take the shape of a seamless cylinder.

In some embodiments, the free ends of joining thread 1240 may be secured after being fully tensioned. The free ends may be secured by knitting, sewing, gluing, thermoplastic melting or other techniques. By securing the free ends of joining thread 1240, second side 1202 and fourth side 1204 may be securely located. That is, joining thread 1240 may restrict second side 1202 and fourth side 1204 from being pulled apart or separated from one another.

FIGS. 13-17 depict one embodiment utilizing a joining thread which facilitates in transforming a two-dimensional knitted component into a three-dimensional knitted component. Additionally, the joining thread may be pre-positioned to connect predetermined areas of a knitted component in a two-dimensional orientation. Because second side 1202 and fourth side 1204 may be physically connected through joining thread 1240 while in a two-dimensional state, additional knitting, threading, or sewing in order to form a three-dimensional structure is not required. Rather, joining thread 1240 is merely pulled in order to form a three-dimensional knitted component. Because the sides of knitted component 1200 are pre-configured and attached in a predetermined manner, tooling may be performed while the sides of knitted component 1200 are already physically attached to one another. This arrangement may increase efficiency in construction and tooling of knitted components. For example, a printed design that extends across the junction of second side 1202 and fourth side 1204 may be formed while knitted component 1200 is in a two-dimensional configuration. Because the sides are pre-configured to join at predetermined desired locations, the sides may be printed upon in a flat orientation and form a three-dimensional representation of the printed material. This arrangement allows the printed material to be more accurately or easily placed upon knitted component 1200 because knitted component 1200 may be in a two-dimensional orientation as opposed to a three-dimensional orientation.

Additionally, various shapes and orientations may be formed by varying the location of predetermined points of connection. For example, in some embodiments the points of connection on second side 1202 may be located closer to the central portion along second side 1202. As fourth side 1204 is connected to second side 1202 by tensioning a joining thread, fourth side 1204 may scrunch or bunch. This is because the points along fourth side 1204 are located further away from one another than are the points along second side 1202. Because of the difference in distance, the points along fourth side 1204 may be forced to occupy a smaller distance and therefore bunch together as each of the points connects along a point of second side 1202. By pre-configuring a joining thread to interact with particular loops in a predetermined manner, a consistent and accurate junction along each of the sides of a knitted component may be formed. Additionally, less labor may be required using such a pre-configured arrangement as compared to other techniques.

Referring to FIGS. 18-25, the formation of a portion of an article of footwear is depicted utilizing a joining thread. As shown, portions of a knitted component are formed on a knitting machine.

Although knitting may be performed by hand, commercial manufacturing of knitted components is generally performed by knitting machines. An example of a knitting machine capable of producing a knitted component, including any of the embodiments of knitted components described herein is depicted in FIGS. 18-25. Additionally, the embodiments herein can make use of any of the apparatus or structures described in Podhajny, U.S. Publication No. 2014/0237861 published on Aug. 28, 2014, entitled "Method of Knitting a Knitted Component with a Vertically Inlaid Tensile Element," the entirety of which is hereby incorporated by reference. In Podhajny knitting machines and techniques are described which may be used to form a knitted component as discussed in this detailed description.

In some embodiments, knitting machine 1764 may include two needle beds. In some embodiments, the needle beds may be angled thereby forming a v-bed. Each needle bed contains a plurality of individual needles that lay on a common plane. A rail extends above and parallel to the intersection of the needle beds. The rail may provide attachment points for feeders. The feeders may supply yarn to the needles in order for the needles to manipulate the yarn. Due to the action of the carriage, the feeders may move along the rail and the needle bed thereby supplying yarn to the needles. The needles may then extend and retract thereby forming a knit structure. In some embodiments, a second rail may be provided which may feed a second supply of yarn to the needles. In such embodiments, a first yarn may interact with a second yarn.

Figure 18:
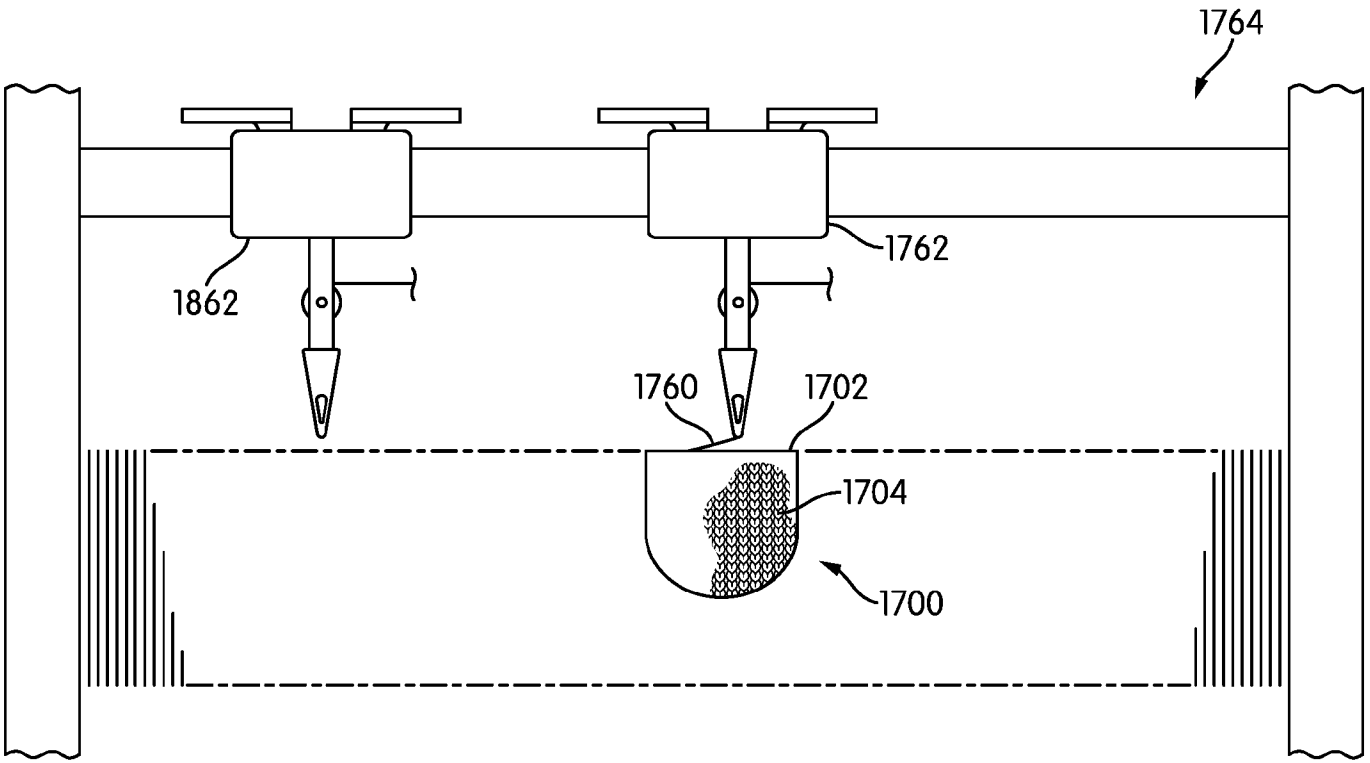
FIG. 18 is a schematic view an exemplary embodiment of a knitted component during an aspect of the knitting process.

Referring to FIG. 18, a tongue portion of a knitted component is formed using a first yarn 1760. A first set of needles may be used to form tongue portion 1700. First feeder 1762 passes first yarn 1760 to a needle bed. The first set of needles may interact with first yarn 1760 thereby forming tongue portion 1700. Tongue portion 1700 may be secured to needles along edge 1702. That is, a portion of tongue portion 1700 may not be cast off from the first set of needles.

Knitting direction, as discussed throughout the Description and claims, refers to the orientation of interlooped yarns or strands forming a course or row of loops that are being joined to successive courses through a knitting process. The knitting direction may be generally defined relative to the direction of the knit material being formed during the knitting process. For example, during a flat knitting process, successive courses of interlooped yarns are joined together to form a knit element by manipulating a yarn through knitting a course or row along a generally horizontal direction to increase the size of the knitted component along a generally vertical direction. Course direction may be used to refer to orientation of courses within a knitted component compared to a base orientation of courses within a knitted component. For example, the base orientation of a course may be horizontal or zero degrees. Some courses may be oriented at a forty-five degree angle with respect to the base orientation. Other courses may be orientated at various angles with respect to the base orientation. Changes in orientation may be formed using gores as well as other methods. As shown in FIG. 18, the course direction of tongue portion 1700 is largely horizontal or parallel to the knitting direction of first feeder 1762.

Figure 19:
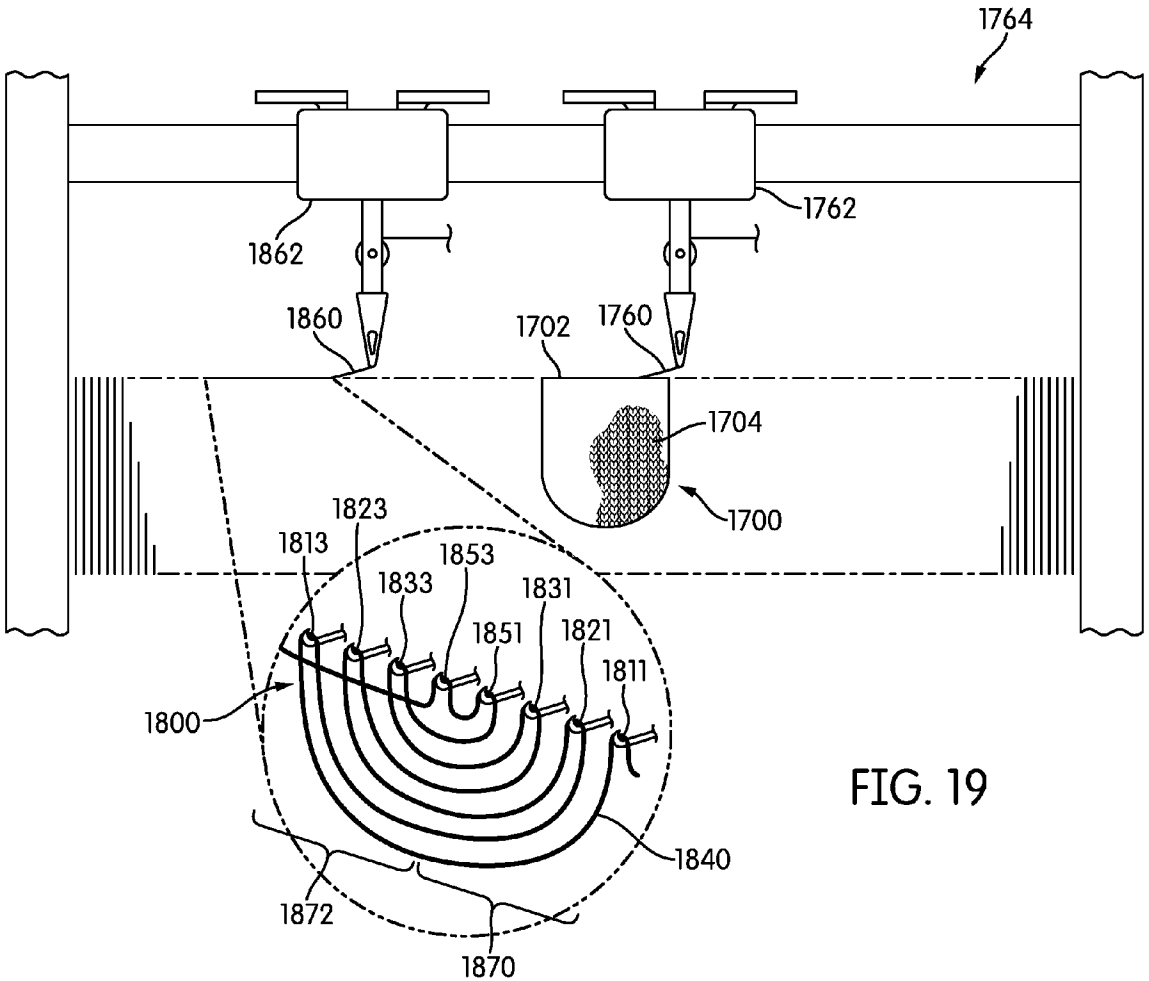
FIG. 19 is a schematic view of an exemplary embodiment of the knitted component and a joining thread during another aspect of the knitting process.

Referring to FIG. 19, a joining portion is formed separately from tongue portion 1700. Joining portion 1800 may be formed using a different rail as well as a different feeder than from which tongue portion 1700 is formed. As shown, joining portion 1800 is formed as a second feeder 1862 passes a second yarn 1860 onto a second set of needles. Second yarn 1860 may be a separate yarn from first yarn 1760. Additionally, in some embodiments, second yarn 1860 may be formed from a different material than first yarn 1760. In FIG. 19, for example, knitting machine 1764 forms two distinct, separate knit structures by using at least two different strands of yarns. As such, tongue portion 1700 and joining portion 1800 may not interact with one another at this point during manufacturing.

In some embodiments, joining portion 1800 may be formed as a knit structure. As shown, joining portion 1800 is depicted as extending between various needles. That is, joining portion 1800 is formed in a substantially linear manner. For example, each of the loops of joining portion 1800 is located within the needles of knitting machine 1764. That is, as depicted, the loops of joining portion 1800 are not cast off of the needles at this point during manufacturing. In other embodiments, joining portion 1800 may be formed as a knit structure incorporating multiple courses. In some embodiments, joining portion 1800 may be formed as a triangular shaped knitted component. In other embodiments, joining portion 1800 may be formed in other shapes.

In some embodiments, joining portion 1800 may include a number of loops. As shown, joining portion 1800 includes a first subset and a second subset. First subset 1870 may be used to refer to loop 1811, loop 1821, loop 1831, and loop 1851. Second subset 1872 may be used to refer to loop 1813, loop 1823, loop 1833, and loop 1853. First subset 1870 and second subset 1872 may abut one another between loop 1853 and loop 1851. Each loop of each subset extends outwards from the abutment of first subset 1870 and second subset 1872. For example, as shown, joining portion 1800 includes loop 1811 located opposite loop 1813. Both loop 1811 and loop 1813 are located furthest away from the junction of first subset 1870 and second subset 1872. In a similar manner, loop 1821 is located opposite loop 1823; loop 1831 is located opposite loop 1833; and loop 1851 is located opposite loop 1853. In other embodiments, a larger number of loops may be utilized to form joining portion 1800.

As shown, joining portion 1800 may incorporate float loops between each of the loops of joining portion 1800. In other embodiments, joining portion 1800 may incorporate an auxiliary element which may occupy the space of float loops or may lessen the length of the sinkers between the loops of joining portion 1800. The auxiliary element may be utilized to orient joining thread 1840 such that portions of joining thread 1840 may not entangle one another as discussed previously in this Detailed Description. In other embodiments, different configurations of joining portion 1800 may utilize an auxiliary element.

In some embodiments, the knitting of tongue portion 1700 may be suspended as joining portion 1800 is formed. In other embodiments, tongue portion 1700 and joining portion 1800 may be formed at the same time. In still further embodiments, joining portion 1800 may be formed before other portions are formed.

At this point during manufacturing as shown in FIG. 19, the knitting machine may include two knit structures, tongue portion 1700 and joining portion 1800. Each of the loops (loop 1811, loop 1813, loop 1821, loop 1823, loop 1831, loop 1833, loop 1851 and loop 1853) of joining portion 1800 may be located within a needle. That is, each of the loops of joining portion 1800 may not be cast off from the needles. Additionally, the loops of tongue portion 1700 along edge 1702 may also be located within needles. The loops along edge 1702 however, may be located within different needles than the loops of joining portion 1800.

Figure 20:
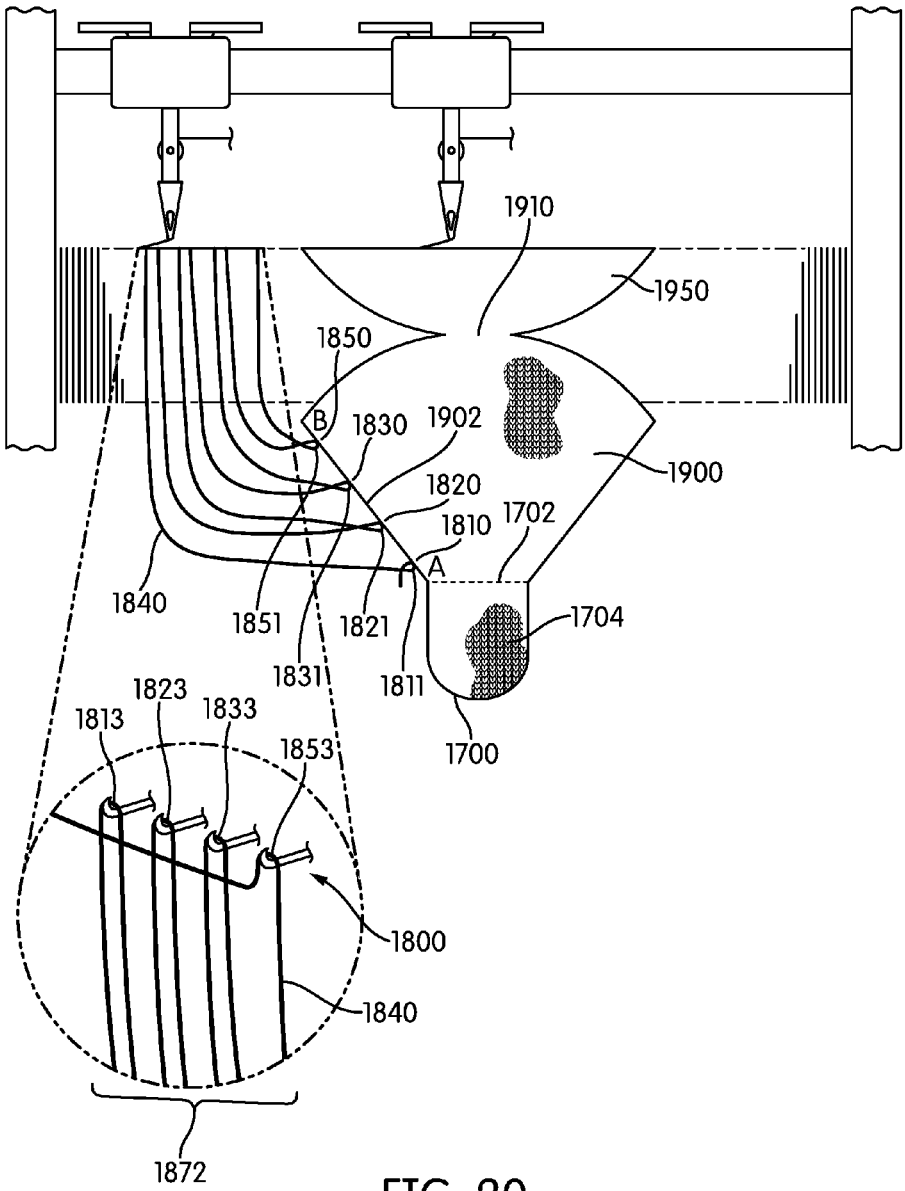
FIG. 20 is a schematic view of an exemplary embodiment of the knitted component and joining thread during another aspect of the knitting process.

Referring to FIG. 20, a vamp portion and part of a lower portion are knitted. As shown, vamp portion 1900 is continuously knit from tongue portion 1700. That is, in some embodiments, vamp portion 1900 and tongue portion 1700 are formed of unitary knit construction. Although edge 1702 is depicted in FIG. 20, edge 1702 may not be visible and is labeled for convenience and reference. Additionally a part of lower portion 1950 may be knitted as well. In some embodiments, lower portion 1950 and vamp portion 1900 may be of unitary knit construction. The course direction of lower portion 1950 and vamp portion 1900 may be largely parallel to the course direction of tongue portion 1700. In some embodiments, lower portion 1950 and vamp portion 1900 may be connected along a region 1910. Region 1910 is not meant to demarcate a specific exact area, rather region 1910 is intended to represent and area which bridges vamp portion 1900 and lower portion 1950 that is of unitary knit construction.

As vamp portion 1900 is knitted, the needles that are holding loops of joining portion 1800 may interact with first yarn 1760 that is used to form vamp portion 1900. As such, joining thread 1840 may interact and interloop with first yarn 1760 that is used to form vamp portion 1900. Loops of first subset 1870 may interact with loops of vamp portion 1900 along side 1902. As shown, loop 1811 may interact with loop 1810 of vamp portion 1900 at a point A, loop 1821 interacts with loop 1820 of vamp portion 1900, loop 1831 interacts with loop 1830 of vamp portion 1900, and loop 1851 interacts with loop 1850 of vamp portion 1900 at point B. In this configuration, the physical junction between joining thread 1840 and loops within vamp portion 1900 may appear as depicted in FIGS. 1-12. That is, joining thread 1840 may be interlooped with a secured course or secured loop of vamp portion 1900.

In some embodiments, joining portion 1800 may be positioned at predetermined locations on the needles of knitting machine 1764. That is, joining thread 1840 may be held on the needles of knitting machine 1764 such that as vamp portion 1900 is formed, particular loops of vamp portion 1900 may interact with particular loops of joining portion 1800. Knitting machine 1764 may be programmed in order to form the junction between side 1902 and first subset 1870. That is, the junction may be formed automatically during the knitting process. As first feeder forms vamp portion 1900, the feeder moves back and forth along a needle bed. The feeder may move to a side that includes joining portion 1800. As the feeder extends to the needles holing loops of joining portion 1800, first strand 1760 and joining portion 1800 may interact and interloop.

As depicted, vamp portion 1900 may be associated with a forefoot region of an article of footwear. Additionally, vamp portion 1900 may be associated with the toes and phalanges of an article of footwear. Further, lower portion 1950 may be associated with the underside of a foot. That is, when completed, lower portion 1950 may be located adjacent the underside of a foot in a completed article of footwear. In other embodiments, various portions of an article of footwear may be formed as well as other knit articles.

As shown in FIG. 20, loops of first subset 1870 of joining portion 1800 may be interlooped with vamp portion 1900 along side 1902. Loop 1813, loop 1823, loop 1833, and loop 1853 may remain within their respective needles. As needles cast off loop 1811, loop 1821, loop 1831, and loop 1851 formed from second yarn 1860 of joining thread 1840, the needles may interact with first yarn 1760 and further form additional portions of vamp portion 1900 as well as a portion of lower portion 1950. Loop 1811 may interloop with loop 1810, loop 1821 may interloop with loop 1820, loop 1831 may interloop with loop 1830, and loop 1851 may interloop with loop 1850. First subset 1870 of joining portion 1800 may now be intermeshed with loops of vamp portion 1900.

Figure 21:
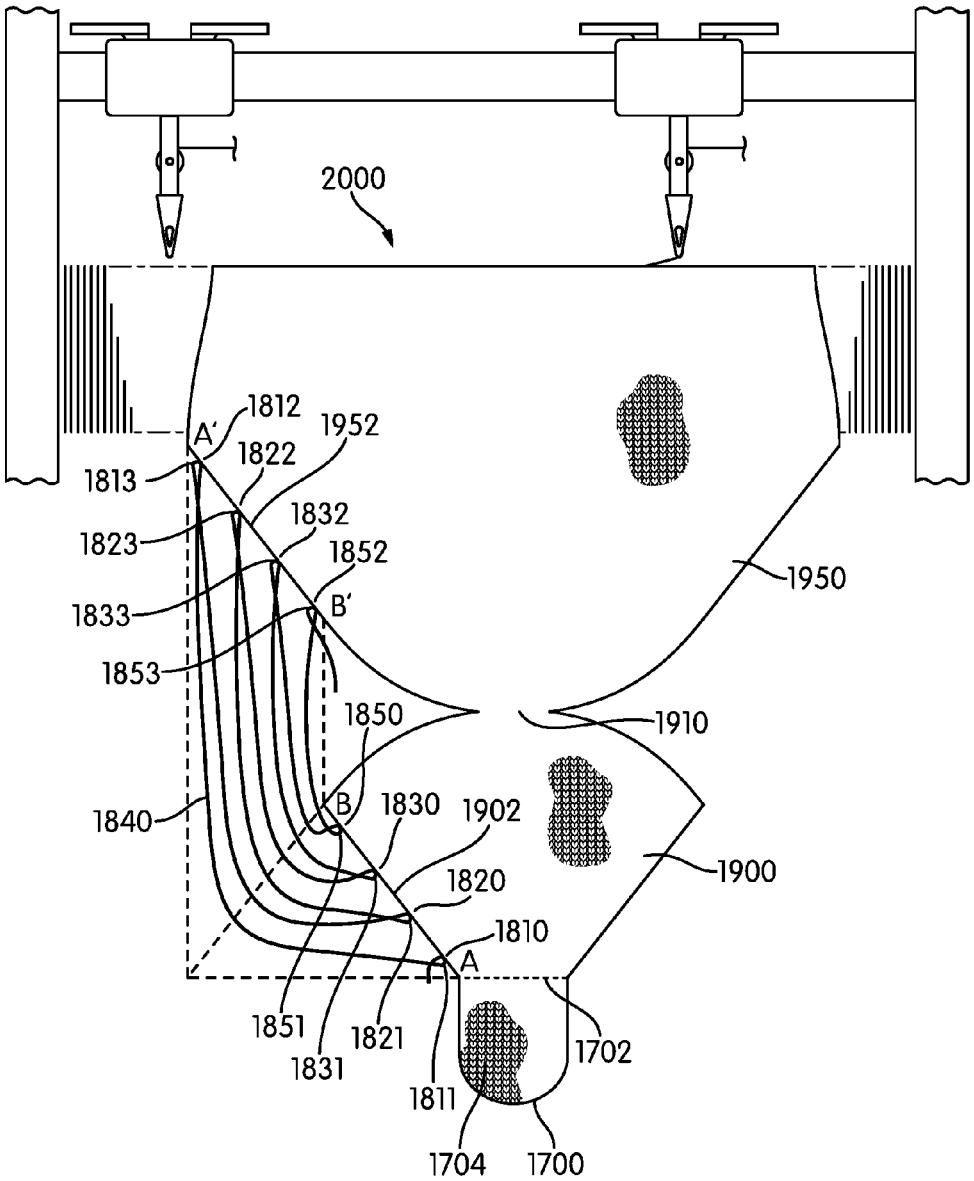
FIG. 21 is a schematic view of an exemplary embodiment of the knitted component and joining thread during another aspect of the knitting process.

Referring to FIG. 21, unattached loops along second subset 1872 of joining portion 1800 may be aligned and attached and interlooped with loops along side 1952 of lower portion 1950 at specific and predetermined locations. First feeder 1762 of knitting machine 1764 traverses back and forth along the rail, the loops of the knitted component eventually may align with the needles that are holding loops of second subset 1872 of joining thread 1840. As first feeder 1762 passes to the needles holding loops of joining thread 1840, the needles extend to accept first yarn 1760 used to form lower portion 1950. As the needles extend, the loops of second subset 1872 of joining thread 1840 are cast off and interlooped with the loops along side 1952 of lower portion 1950. In this state, loops of joining thread 1840 are interlooped with loops along side 1902 of vamp portion 1900 as well as with loops along side 1952 of lower portion 1950.

In some embodiments, joining portion 1800 may be positioned at predetermined locations within the needles of knitting machine 1764. That is, joining thread 1840 may be placed within the needles of knitting machine 1764 such that as lower portion 1950 is formed, particular loops of lower portion 1950 may interact with particular loops of joining portion 1800. Knitting machine 1764 may be programmed in order to form the junction between side 1952 and second subset 1872. That is, the junction may be formed automatically during the knitting process. Therefore, different areas of knitted component 2000 may be physically connected in an automated manner.

In some embodiments, the angle of the thread within joining portion 1800 may be altered. As second subset 1872 of joining thread 1840 interloops with side 1952 of lower portion 1950, the loops of second subset 1872 may interact with loops from different courses of lower portion 1950. By interacting with different courses of lower portion 1950, second subset 1872 may be located at an angle with respect to courses within lower portion 1950. Additionally, in this orientation, second subset 1872 may be oriented at an angle with respect to first subset 1870.

In some embodiments, loops of second subset 1872 may interact and interloop with lower portion 1950. Loop 1853 may interact with loop 1852 at point B' of lower portion 1950; loop 1833 may interact with loop 1832 of lower portion 1950; loop 1823 may interact with loop 1822 of lower portion 1950 and loop 1813 may interact with loop 1812 at point A' of lower portion 1950. The interactions between these loops may be similar as to interactions previously discussed between knitted components and joining thread 1840 or other embodiments of joining threads as discussed with relation to FIGS. 1-12.

In some embodiments, the entirety of the knitted component may be completed and removed from knitting machine 1764. In some embodiments, the knitted component may comprise lower portion 1950 and vamp portion 1900. In other embodiments, other portions may be included to form a knitted component.

As shown in FIG. 21, knitted component 2000 includes lower portion 1950, vamp portion 1900, and tongue portion 1700. Once removed from knitting machine 1764, knitted component 2000 may appear as knitted component 2000 appears in FIG. 21. That is, knitted component 2000 may be substantially two-dimensional with joining thread 1840 extending between various loops of knitted component 2000. Additionally, vamp portion 1900 may be attached to lower portion 1950 by joining thread 1840.

In this two-dimensional or planar configuration, tooling and dyeing of knitted component 2000 may be performed while knitted component 2000 is in a two-dimensional orientation. This arrangement may provide for ease of assembly over performing tooling and dyeing when knitted component 2000 is in a three-dimensional state. Further, because locations of joining thread 1840 may be preprogrammed to connect at certain predetermined locations, the amount of labor required to connect parts of knitted component 2000 may be less than in other methods of connecting portions of a knitted component in order to form a three-dimensional object.

Figure 22:
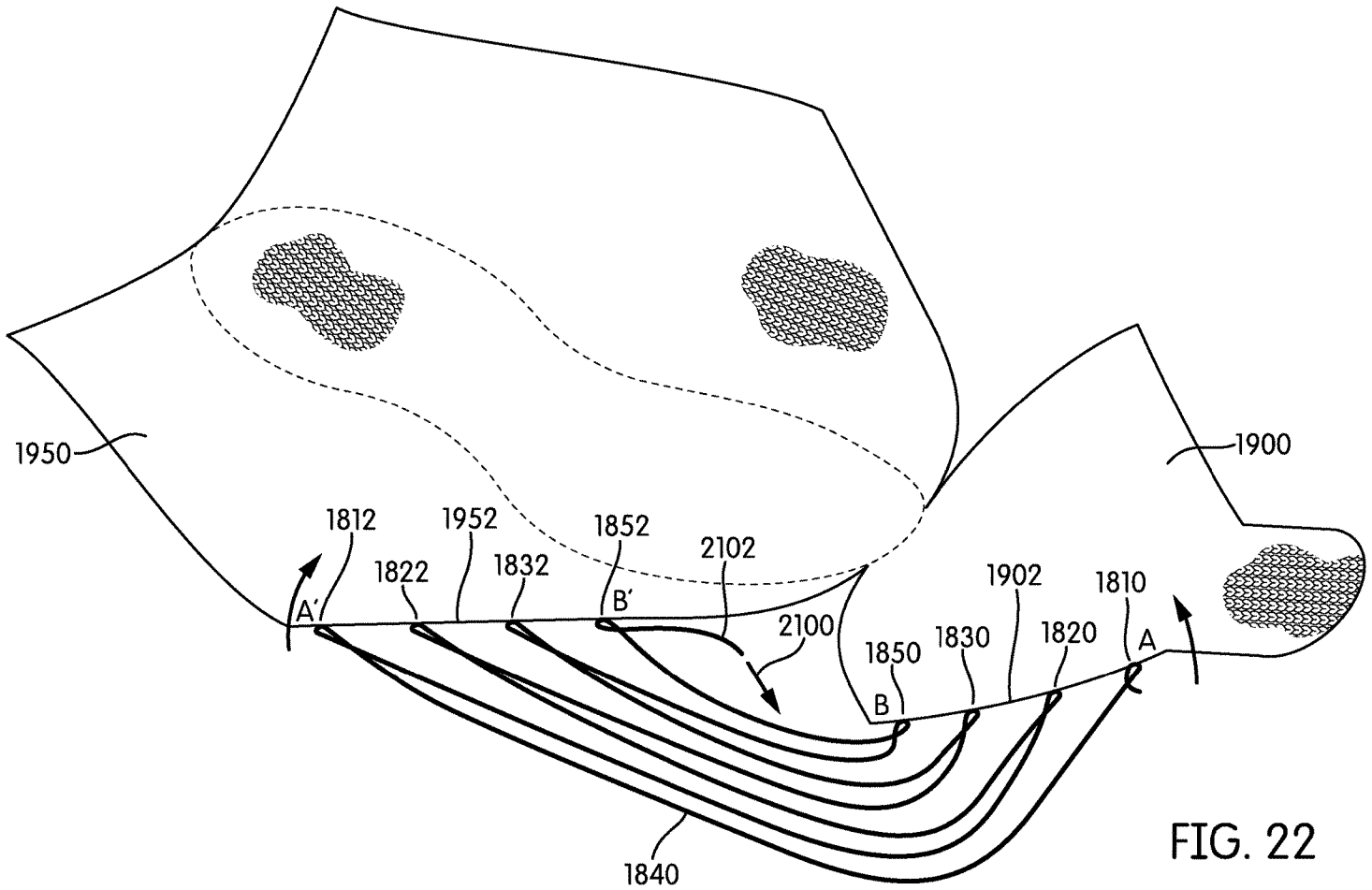
FIG. 22 is a schematic view of the knitted component and a joining yarn of FIGS. 18-21 being subjected to a tensile force.
Figure 23:
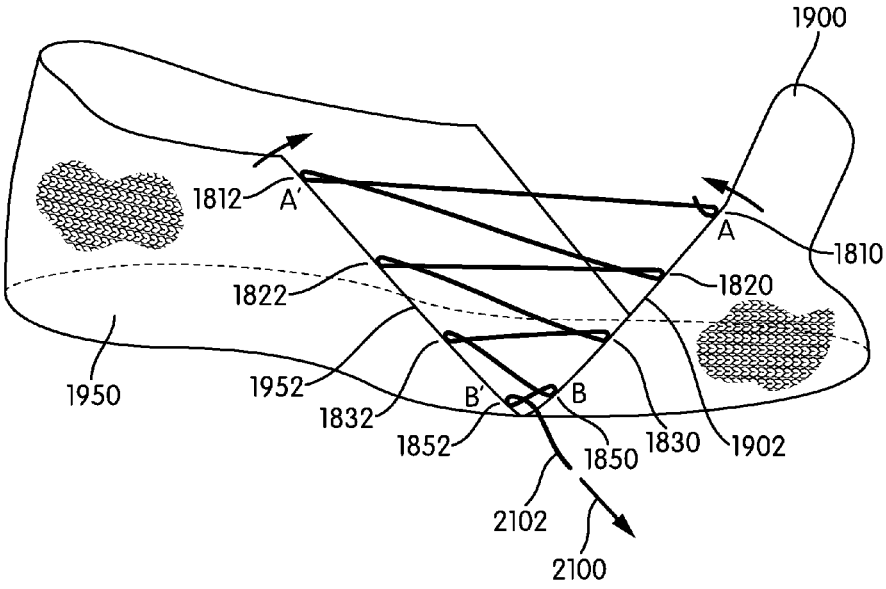
FIG. 23 is another schematic view of the knitted component and a joining yarn of FIGS. 18-21 being subjected to a tensile force.
Figure 24:
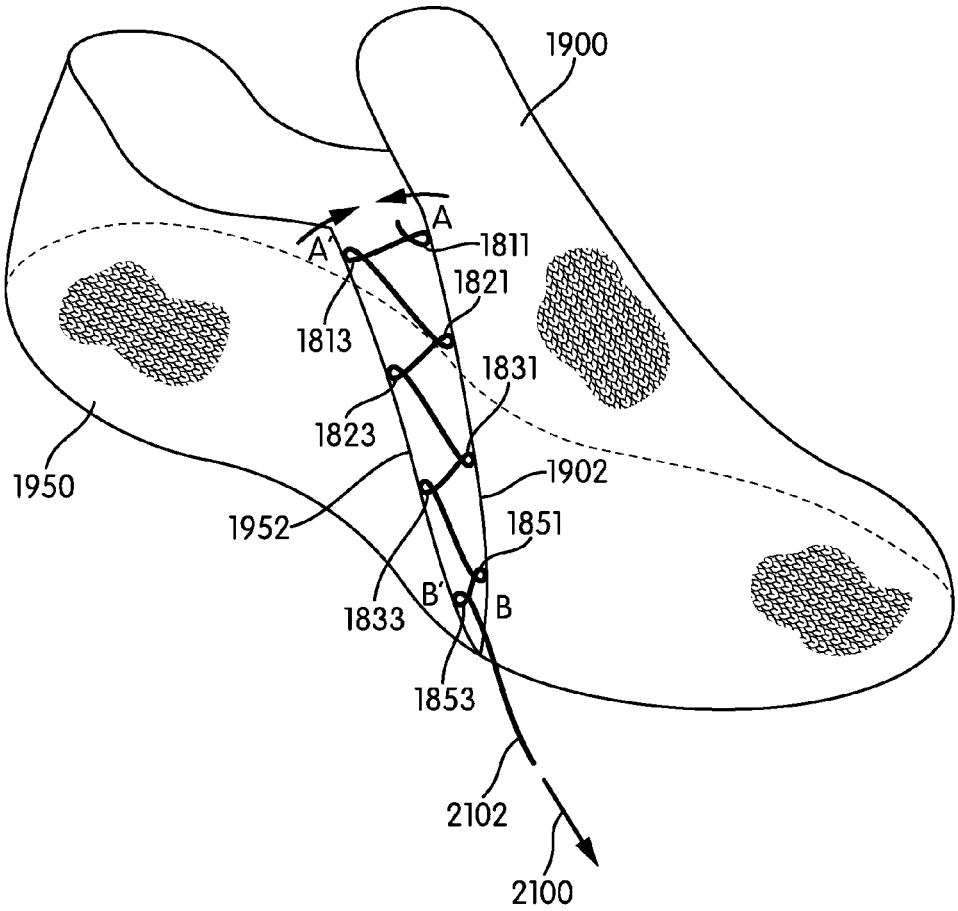
FIG. 24 is another schematic view of the knitted component and a joining yarn of FIGS. 18-21 being subjected to a tensile force.
Figure 25:
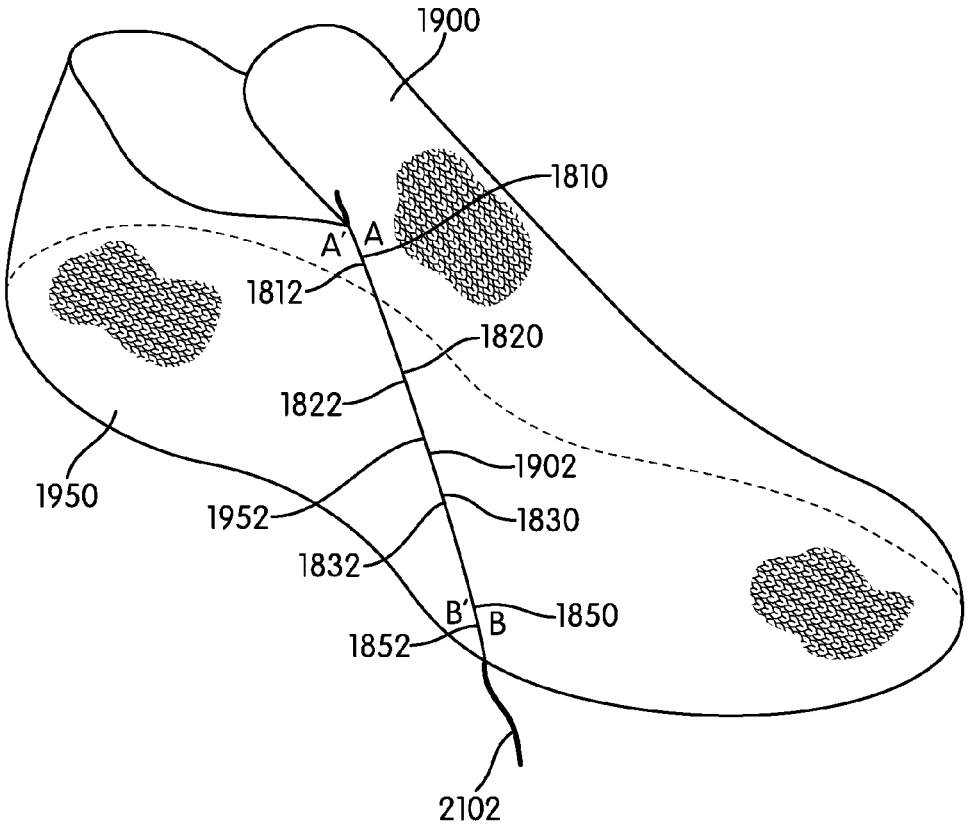
FIG. 25 is an isometric view of an article of footwear formed from the knitted component of FIGS. 18-24.

Referring to FIGS. 22-24, knitted component 2000 is removed from the knitting machine. As shown, joining thread 1840 may be subjected to a tensile force 2100 at end 2102 of joining thread 1840. As end 2102 is tensioned, side 1902 of vamp portion 1900 may be pulled toward side 1952 of lower portion 1950. Because vamp portion 1900 and lower portion 1950 may be restricted from rotating in the same two-dimensional plane, due to the connection at region 1910, both portions may rotate into a different plane, and thereby form a three-dimensional shape. In other embodiments, parts of a knitted component may form a two-dimensional article after tensioning due to the particular layout and geometry of the knitted component or components.

As end 2102 is continuously pulled or tensioned, side 1902 and side 1952 eventually may abut one another. The abutment may appear as discussed in relation to FIGS. 1-12. That is, joining thread 1840 may appear as a straight line through the courses of knitted component 2000. Additionally, joining thread 1840 may be obscured from visibility by loops of vamp 1950 and lower portion 1952. Further, the courses of vamp 1950 and lower portion 1952 may appear as though each is directly interlooped an intermeshed with the other. In this sense, a seamless abutment between side 1902 and side 1952 may be formed.

As shown, joining portion 1800 may be specifically located in order to join particular points of side 1902 toward points of side 1952. For example, joining portion 1800 may be arranged such that loop 1852 of side 1952 may align with loop 1850 of side 1902. As shown, loop 1851 is located adjacent to loop 1850 of side 1902 such that as vamp 1950 is knitted loop 1850 may interloop with loop 1851 at point B. Similarly, loop 1853 is positioned such that loop 1853 may interact with a loop 1852 at point B' as lower portion 1950 is formed. In this particular embodiment, as joining thread 1840 is tensioned, loop 1853 and loop 1851 will move toward each other. Because loop 1853 directly connects to loop 1851 (that is, joining thread 1840 extends between loop 1853 and loop 1851), when joining thread 1840 is tensioned loop 1853 will move toward 1851. Therefore, the loops of joining portion 1800 may be positioned in conjunction with the knitted portions in order to achieve particular connection points. By moving the location of the loops of joining portion 1800, different connection points and shapes may be formed.

Figure 26:
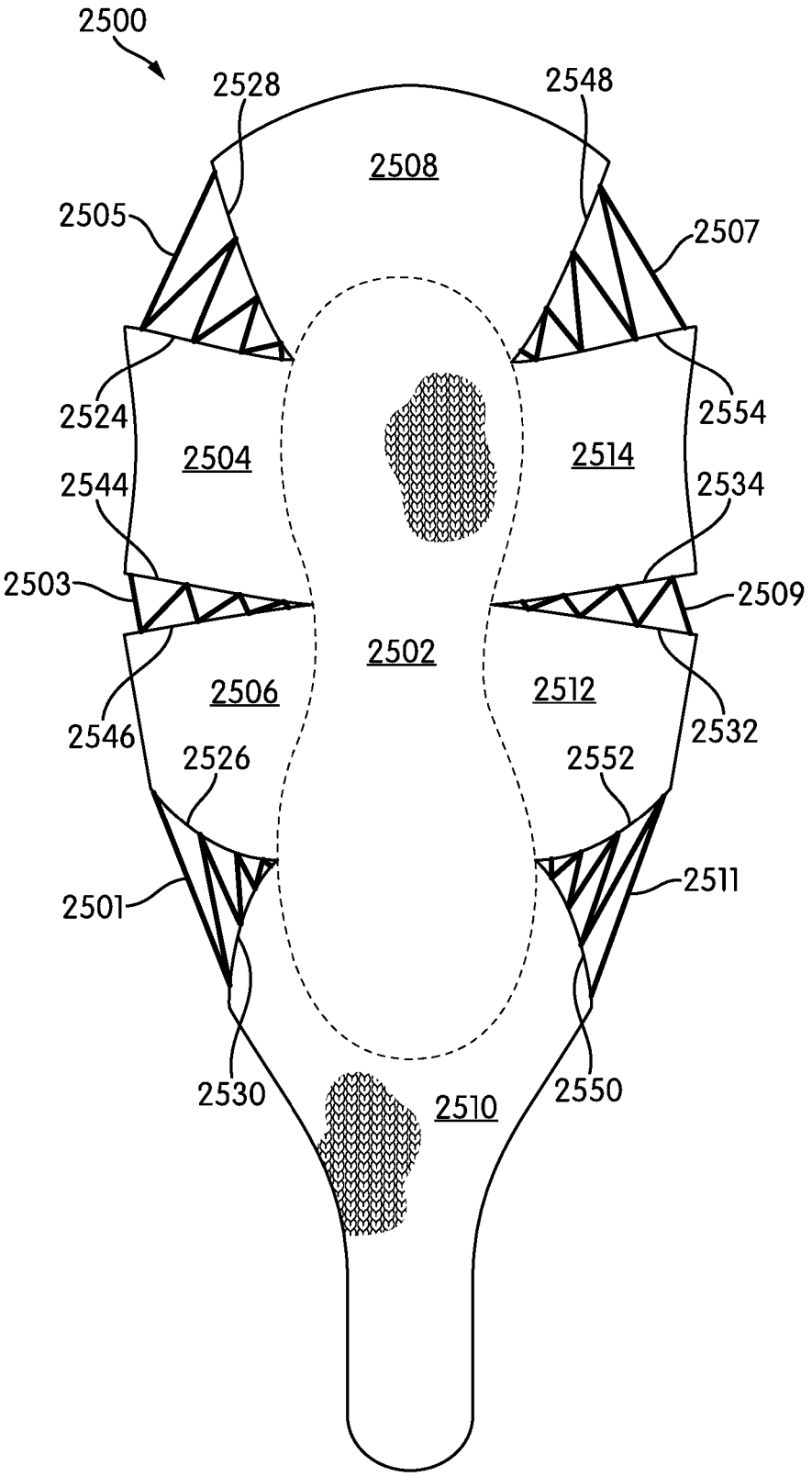
FIG. 26 is a top view of an embodiment of a knitted component incorporating multiple joining yarns.
Figure 27:
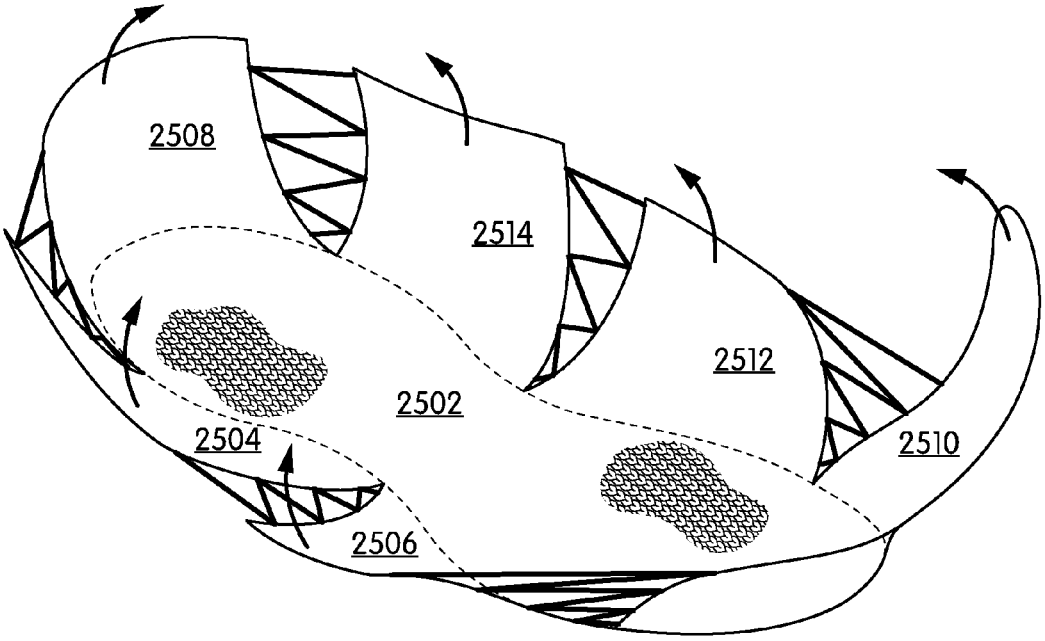
FIG. 27 is an isometric view of the knitted component of FIG. 26 in a partially formed state.
Figure 28:
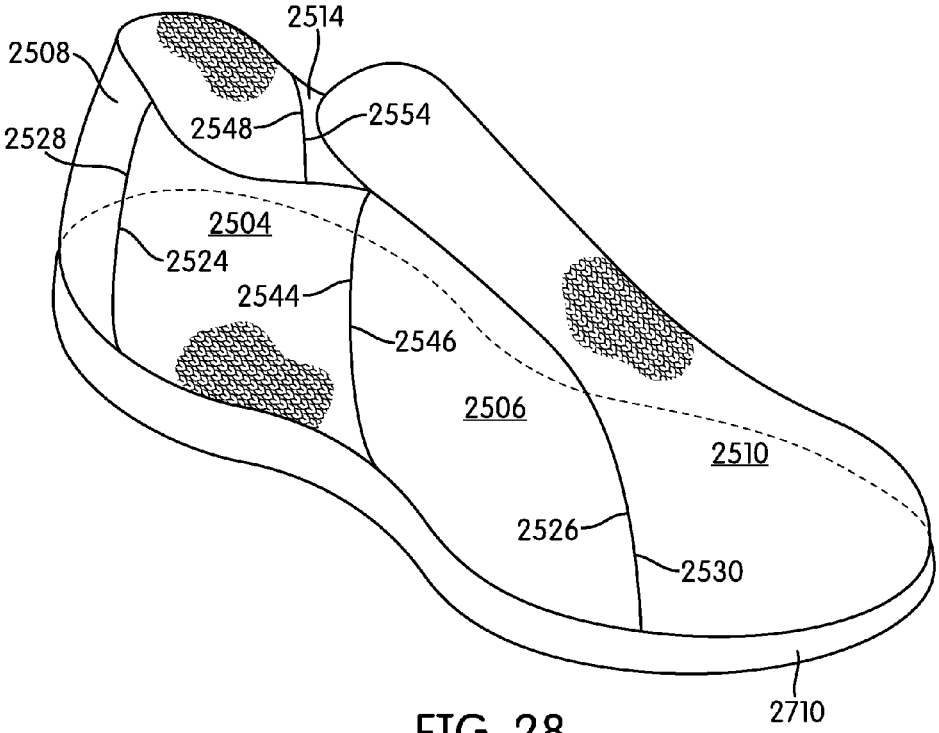
FIG. 28 is an isometric view of an embodiment of an article of footwear formed from the knitted component of FIG. 26.

Referring to FIGS. 26-28, an alternative embodiment of a knitted component utilizing a joining thread is depicted. In some embodiments, multiple joining threads may be utilized to join multiple areas or portions of a knitted component together.

As shown, knitted component 2500 utilizes multiple joining threads. Knitted component 2500 may be formed of unitary knit construction. Knitted component 2500 may include various portions. In the embodiment depicted, knitted component 2500 includes a lower portion 2502 a lateral rearward portion 2504, a lateral forward portion 2506, a medial rearward portion 2514, a medial forward portion 2512, a heel portion 2508 and a vamp portion 2510. Each portion may be attached to an adjacent portion by a joining thread. As shown, side 2530 of vamp portion 2510 may be attached to side 2526 of lateral forward portion 2506 by joining thread 2501. Side 2546 of lateral forward portion 2506 may be attached to side 2544 of lateral rearward portion 2504 by joining thread 2503. Side 2524 of lateral rearward portion 2504 may be attached to side 2528 of heel portion 2508 by joining thread 2505. Side 2548 of heel portion 2508 may be attached to side 2554 of medial rearward portion 2514 by joining thread 2507. Side 2534 of medial rearward portion 2514 may be joined to side 2532 of medial forward portion 2512 by joining thread 2509. Side 2552 of medial forward portion 2512 may be attached to side 2550 of vamp portion 2510 by joining thread 2511.

As discussed in relation to previous embodiments, the joining threads may include at least one end that is unsecured. That is, at least one end may be tensioned or pulled and force the rest of the joining thread to pass through the loops with which the joining thread is intertwined (such as depicted in FIGS. 1-12). Additionally, in some embodiments, the joining thread and the knitted component may be formed on a knitting machine such that the joining thread may intertwine and interact with loops of knitted component 2500 at predetermined locations. By attaching the different portions of knitted component 2500 to each other while knitted component 2500 is still on the knitting machine additional steps of attaching the portions after the knitted component is removed from the knitting machine are not necessary.

Additionally, in a loosely connected state, as shown in FIG. 26, knitted component 2500 may be subjected to tooling and dyeing while in a two-dimensional orientation. This may allow for ease of customization of an article of footwear.

Referring to FIG. 27, an isometric view of knitted component 2500 is depicted in a partially conformed state. At least one end of joining thread 2501, joining thread 2503, joining thread 2505, joining thread 2507, joining thread 2509, and joining thread 2511 is subjected to a force. In some embodiments, each end may be subjected to a force at the same time. In other embodiments, each end may be subjected to a force and different times. As each of the joining threads is subjected to force, each of the sides with which the joining threads are interlooped may begin to move toward one another (as seen in FIG. 27). Due to the shape and relative spacing of the portions of knitted component 2500, the portions may extend or fold out of a planar two-dimensional shape and into a three-dimensional shape.

Referring to FIG. 28, the joining threads are tensioned such that each of the sides abuts the other. For example, side 2548 abuts to side 2554 thereby forming a seamless connection between heel portion 2508 and medial rearward portion 2514. As each joining thread is tensioned, knitted component 2500 may form the shape of an article of footwear. In some embodiments, article of footwear 2700 may further include a sole structure 2710. In some embodiments, sole structure 2710 may be adhered to lower portion 2502 before the joining threads are tensioned. In such embodiments, sole structure 2710 may be adhered by any known means. By securing sole structure 2710 to lower portion 2502 while knitted component 2500 is in a two-dimensional state, positioning and attaching sole structure 2710 to lower portion 2502 the amount of labor required to attach sole structure 2710 to lower portion 2502 may be less than methods requiring sole structure 2710 to be attached to a three-dimensional knitted component.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims. As used in the claims, "any of" when referencing the previous claims is intended to mean (i) any one claim, or (ii) any combination of two or more claims referenced.

What is claimed is:

1. A method of forming a knitted component, the method comprising the steps of:

knitting a first portion of the knitted component with a first thread along a first course direction;

knitting a second portion of the knitted component with a second thread, the first thread being distinct from the second thread; the second portion of the knitted component having a first engaging subset including a plurality of loops and a second engaging subset including a plurality of loops, the plurality of loops being held by a plurality of needles; the first portion of the knitted component having a first engaging side including a plurality of loops;

interlooping at least one of the plurality of loops of the first engaging subset with at least one of the plurality of loops of the first engaging side;

knitting a third portion of the knitted component with the first thread along the first course direction, the third portion of the knitted component including a second engaging side including a plurality of loops; wherein the first engaging side and the second engaging side are located at an angle greater than 0 degrees with respect to one another; and interlooping at least one of the plurality of loops of the second engaging subset with at least one of the plurality of loops of the second engaging side.

2. The method according to claim 1, wherein the knitted component is configured to be incorporated into an upper of an article of footwear; and wherein the knitted component includes a base portion, the base portion including a lateral side and a medial side, the first engaging side and the second engaging side extending away from the lateral side.

3. The method according to claim 1, wherein the knitted component is configured to be incorporated into an upper of an article of footwear; and wherein the knitted component includes a base portion, the base portion including a lateral side and a medial side, the first engaging side and the second engaging side extending away from the medial side.

4. The method according to claim 1, wherein the first engaging subset includes a first loop, the second engaging subset includes a second loop, while located on the plurality of needles, the first loop being located adjacent to the second loop.

5. The method according to claim 1, wherein the first loop interloops with the first engaging side adjacent to a base portion, the second loop interloops with the second engaging side adjacent to the base portion.

6. The method according to claim 1, wherein the knitted component further comprises a fourth portion including a third edge, the third edge not being interlooped with the second portion.

7. A method of assembling an article of footwear incorporating a knitted component into an upper, the method comprising: forming the knitted component in a planar configuration including a first edge and a second edge; wherein the first edge and the second edge are oblique with respect to each other; the knitted component being formed of courses which are secured; knitting a joining thread between the first edge and the second edge in a planar configuration, the joining thread including a first end and a second end, at least one of the first end and the second end being unsecured, the joining thread interlooping with at least one loop on the first edge and the joining thread interlooping with at least one loop on the second edge; tensioning at least one of the first end and the second end of the joining thread such that the first edge and the second edge extend toward one another; and incorporating the knitted component into the upper of the article of footwear.

8. The method according to claim 7, wherein the upper of the article of footwear includes a lateral side and a medial side, the first edge and the second edge being located on the lateral side.

9. The method according to claim 7, wherein the upper of the article of footwear includes a lateral side and a medial side, the first edge and the second edge being located on the medial side.

10. The method according to claim 7, wherein at least one loop of the first side abuts at least one loop of the second side upon tensioning of the joining thread.

11. The method according to claim 7, wherein the upper of the article of footwear includes a base portion, a first portion, and a second portion, the first portion including at least one loop that abuts at least one loop of the second portion.

12. The method according to claim 7, wherein the first portion extends from the base portion and the second portion extends from the base portion, the first portion including an area that is in a fixed relationship to the base portion, the second portion including an area that is in a fixed relationship to the base portion.

13. The method according to claim 7, wherein the first portion includes the first edge, the second portion includes the second edge, and wherein as the joining thread is tensioned the first portion and the second portion extend out of a plane in which the base portion is located.

14. The method according to claim 7, wherein the first portion corresponds to a forefoot portion and wherein the second portion corresponds to a midfoot portion.

15. The method according to claim 7, wherein the upper of the article of footwear further comprises a third portion and a fourth portion, the third portion and the fourth portion including a third edge and a fourth edge, a second joining thread extending between the third edge to the fourth edge, wherein as the second joining thread is tensioned, at least one loop located on the third edge abuts at least one loop located on the fourth edge.

* * * * *